US010444699B2

(12) United States Patent
Sakurai

(10) Patent No.: US 10,444,699 B2
(45) Date of Patent: Oct. 15, 2019

(54) DRIVE TRANSMISSION MECHANISM, DRIVING DEVICE, AND IMAGE FORMING APPARATUS HAVING A SWITCHABLE TRANSMISSION OF ROTATIONAL FORCE

(71) Applicant: FUJI XEROX CO., LTD., Tokyo (JP)

(72) Inventor: Masami Sakurai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/118,453

(22) Filed: Aug. 31, 2018

(65) Prior Publication Data

US 2019/0278220 A1 Sep. 12, 2019

(30) Foreign Application Priority Data

Mar. 12, 2018 (JP) ..... 2018-044081

(51) Int. Cl.
*G03G 15/00* (2006.01)
*G03G 21/18* (2006.01)

(52) U.S. Cl.
CPC ..... *G03G 21/1853* (2013.01); *G03G 21/186* (2013.01); *G03G 21/1864* (2013.01); *G03G 2221/1657* (2013.01); *G03G 2221/1861* (2013.01); *G03G 2221/1884* (2013.01)

(58) Field of Classification Search
CPC ..... G03G 21/1623; G03G 21/1633; G03G 21/1647; G03G 21/1857; G03G 21/186; G03G 21/1864
USPC ..... 399/110, 167
See application file for complete search history.

(56) References Cited

U.S. PATENT DOCUMENTS

| | | | | |
|---|---|---|---|---|
| 8,577,258 | B2 | 11/2013 | Uehara et al. | |
| 9,983,537 | B2 * | 5/2018 | Mizuno | G03G 21/1647 |
| 10,120,328 | B2 * | 11/2018 | Ishida et al. | G03G 21/1647 |

FOREIGN PATENT DOCUMENTS

| | | |
|---|---|---|
| JP | 2011186142 | 9/2011 |
| JP | 2015-102770 | 6/2015 |
| JP | 2016-102893 | 6/2016 |

* cited by examiner

*Primary Examiner* — William J Royer
(74) *Attorney, Agent, or Firm* — JCIPRNET

(57) ABSTRACT

A drive transmission mechanism includes plural first drive transmission units arranged to be movable in an axial direction of respective rotation axes that are adjacent to each other, each first drive transmission unit being rotationally driven; plural second drive transmission units, each of which is disposed adjacent to a corresponding one of the first drive transmission units in the axial direction and is capable of engaging with and disengaging from the corresponding first drive transmission unit to enable and disable transmission of a rotational driving force; and a switching unit disposed to maintain a position thereof in a direction crossing the axial direction, the switching unit moving each of the first drive transmission units in the axial direction to switch between a state in which the transmission of the rotational driving force is enabled and a state in which the transmission of the rotational driving force is disabled.

10 Claims, 27 Drawing Sheets

DRIVE TRANSMISSION MECHANISM, DRIVING DEVICE, AND IMAGE FORMING APPARATUS HAVING A SWITCHABLE TRANSMISSION OF ROTATIONAL FORCE

CROSS-REFERENCE TO RELATED APPLICATIONS

This application is based on and claims priority under 35 USC 119 from Japanese Patent Application No. 2018-044081 filed Mar. 12, 2018.

BACKGROUND

(i) Technical Field

The present invention relates to a drive transmission mechanism, a driving device, and an image forming apparatus.

(ii) Related Art

An existing image forming apparatus includes a driving device for driving an image forming unit, which includes a photoconductor drum, a developing device, and other components and which is detachably attached to an apparatus body. The driving device is structured so that transmission of a rotational driving force to the photoconductor drum, the developing device, and other components of the image forming unit is disabled when a front cover, for example, of the apparatus body is opened to attach or remove the image forming unit.

SUMMARY

According to an aspect of the invention, there is provided a drive transmission mechanism including plural first drive transmission units arranged to be movable in an axial direction of respective rotation axes that are adjacent to each other, each first drive transmission unit being rotationally driven; plural second drive transmission units, each of which is disposed adjacent to a corresponding one of the first drive transmission units in the axial direction and is capable of engaging with and disengaging from the corresponding one of the first drive transmission units to enable and disable transmission of a rotational driving force; and a switching unit disposed to maintain a position thereof in a direction crossing the axial direction, the switching unit moving each of the first drive transmission units in the axial direction to switch between a state in which the transmission of the rotational driving force is enabled and a state in which the transmission of the rotational driving force is disabled.

BRIEF DESCRIPTION OF THE DRAWINGS

An exemplary embodiment of the present invention will be described in detail based on the following figures, wherein.

DETAILED DESCRIPTION

An exemplary embodiment of the present invention will now be described with reference to the drawings.

Figure 1:
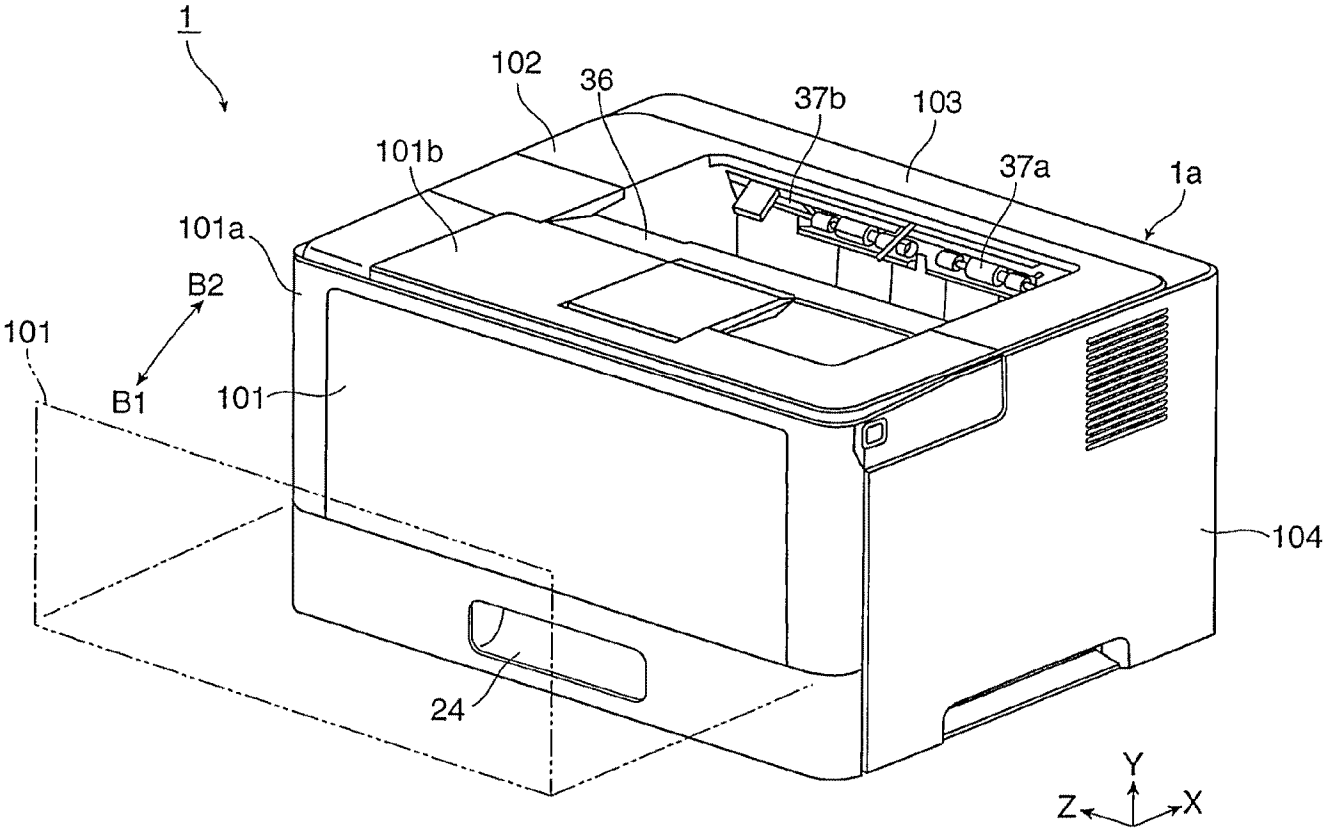
FIG. 1 is an external perspective view of an image forming apparatus incorporating a drive transmission mechanism and a driving device according to an exemplary embodiment of the present invention.
Figure 2:
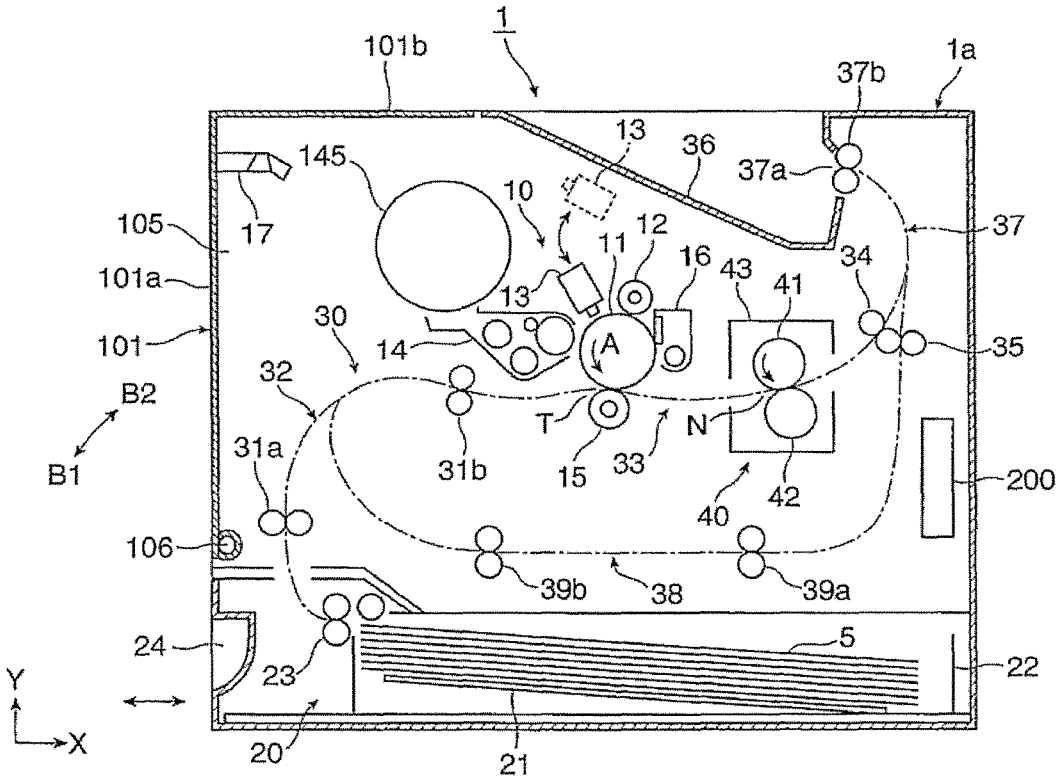
FIG. 2 is a schematic diagram illustrating the overall structure of the image forming apparatus.
Figure 3:
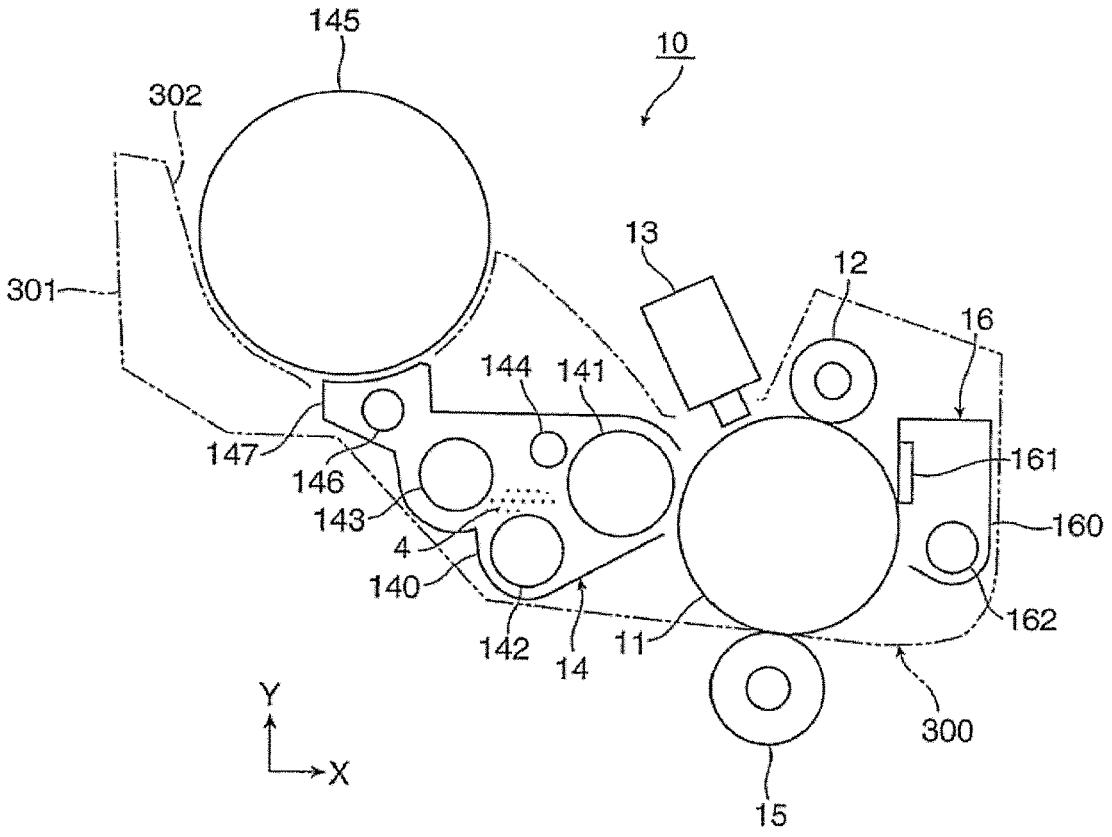
FIG. 3 illustrates an image forming unit included in the image forming apparatus.

FIGS. 1 to 3 illustrate an image forming apparatus 1 incorporating a drive transmission mechanism and a driving device according to the exemplary embodiment. FIG. 1 illustrates the overall external appearance of the image forming apparatus 1. FIG. 2 illustrates the overall structure of the image forming apparatus 1. FIG. 3 is an enlarged view of a portion (image forming unit) of the image forming apparatus 1. In the drawings, arrow X shows a horizontal depth direction, arrow Y shows the vertical direction, and arrow Z shows a horizontal width direction.

Overall Structure of Image Forming Apparatus

The image forming apparatus 1 according to the exemplary embodiment is structured as, for example, a monochrome printer. As illustrated in FIG. 1, the image forming apparatus 1 includes an apparatus body 1*a* that is substantially rectangular parallelepiped shaped and has a height less than the depth thereof. The apparatus body 1*a* includes a front cover 101, which is an example of an opening-closing member, at a front side thereof which the operator faces when operating the image forming apparatus 1. The front cover 101 is movable in the direction of arrows B1 and B2 to be opened and closed. The front cover 101 includes a front portion 101*a* disposed at the front side of the apparatus body 1*a* and a top portion 101*b* disposed at the top side of the apparatus body 1*a* in a region adjacent to the front side. The top portion 101*b* of the front cover 101 is movable with respect to the apparatus body 1*a* to be opened and closed independently of the front portion 101*a*. In addition, a paper discharge portion 36 is disposed in an inclined position at the top of the apparatus body 1*a*. Recording paper sheets 5, which are an example of recording media on which an image is formed, are discharged to the paper discharge portion 36. The apparatus body 1*a* includes support structure members and outer covers 101 to 104 including the front cover 101.

As illustrated in FIG. 2, the image forming apparatus 1 includes an image forming device 10, a sheet feeding device 20, a transport device 30, and a fixing device 40. The image forming device 10 forms a toner image developed by using toner contained in developer. The sheet feeding device 20 stores recording paper sheets 5 to be supplied to a transfer position in the image forming device 10, and supplies the recording paper sheets 5. The transport device 30 transports each recording paper sheet 5 supplied from the sheet feeding device 20 along transport paths shown by the one-dot chain lines in FIG. 2. The fixing device 40 fixes the toner image that has been transferred to the recording paper sheet 5 in the image forming device 10.

The image forming device 10 includes a rotating photoconductor drum 11 as an example of an image forming portion (image carrier). The photoconductor drum 11 is surrounded by devices described below, which are also examples of image forming portions. The devices include a charging device 12, an exposure device 13, a developing device 14, a transfer device 15, and a drum cleaning device 16. The charging device 12 charges a peripheral surface (image carrying surface) of the photoconductor drum 11, which allows an image to be formed thereon, to a certain potential. The exposure device 13 irradiates the charged peripheral surface of the photoconductor drum 11 with light based on image information (signal) to form an electrostatic latent image having a potential difference. The developing device 14 develops the electrostatic latent image into a toner image by using toner contained in black developer. The transfer device 15 transfers the toner image to the recording paper sheet 5. The drum cleaning device 16 cleans the image carrying surface of the photoconductor drum 11 by removing the toner and other deposits that remain on the image carrying surface after the transfer process.

The photoconductor drum 11 includes a hollow or solid cylindrical base member that is grounded and an image carrying surface having a photoconductive layer made of a photosensitive material (photosensitive layer) formed on the base member. The photoconductor drum 11 is supported such that the photoconductor drum 11 is rotated in the direction of arrow A when a driving force is transmitted thereto from a driving device, as described below.

The charging device 12 includes a contact charging roller arranged to be in contact with the photoconductor drum 11. The charging device 12 receives a charging voltage. In the case where the developing device 14 is a device that performs a reversal development, a voltage or current of the same polarity as the polarity to which the toner supplied from the developing device 14 is charged is supplied as the charging voltage. The charging device 12 may instead include a non-contact charging device, such as a scorotron, which is not in contact with the surface of the photoconductor drum 11.

The exposure device 13 includes an LED print head including plural light emitting diodes (LEDs), which are light emitting devices, arranged in the axial direction of the photoconductor drum 11. The LED print head forms an electrostatic latent image by irradiating the photoconductor drum 11 with light corresponding to the image information emitted from the LEDs. The exposure device 13 is movable in response to an opening-closing operation of the front cover 101 between an exposure position that is close to the photoconductor drum 11 and a retracted position that is apart from the peripheral surface of the photoconductor drum 11 and that is shown by the broken lines in FIG. 2. The exposure device 13 may instead be configured to perform deflection scanning so that the photoconductor drum 11 is scanned with laser light based on the image information in the axial direction. In the case where the exposure device 13 is configured to perform deflection scanning by using laser light, it is not necessary to retract the exposure device 13 since the peripheral surface of the photoconductor drum 11 may be exposed to light emitted from a position apart therefrom.

As illustrated in FIG. 3, the developing device 14 includes a developing roller 141, two stirring transport members 142 and 143, and a layer-thickness regulating member 144, which are disposed in a housing 140 having an opening and a storage chamber for a developer 4. The developing roller 141 is an example of a developer carrying unit that carries the developer 4 and transports the developer 4 to a developing region in which the developing roller 141 faces the photoconductor drum 11. The stirring transport members 142 and 143 are, for example, screw augers that transport the developer 4 while stirring the developer 4 so that the developer 4 passes the developing roller 141. The layer-thickness regulating member 144 regulates the amount (layer thickness) of the developer carried by the developing roller 141. A developing bias voltage is applied between the developing roller 141 of the developing device 14 and the photoconductor drum 11 by a power supply device (not shown). As described below, the developing roller 141 and the stirring transport members 142 and 143 receive a driving force from the driving device and rotate in certain directions. The developer 4 is two-component developer containing non-magnetic toner and magnetic carrier.

As illustrated in FIG. 2, the transfer device 15 is a contact transfer device including a transfer roller that rotates while being in contact with the periphery of the photoconductor drum 11 with the recording paper sheet 5 interposed therebetween and to which a transfer voltage is supplied during an image forming operation. The transfer voltage is a direct-current voltage having a polarity opposite to the polarity to which the toner is charged, and is supplied by the power supply device (not shown).

As illustrated in FIG. 3, the drum cleaning device 16 includes a container body 160 that has an opening, a cleaning plate 161, and a transport member 162. The cleaning plate 161 is pressed against the peripheral surface of the photoconductor drum 11 at a certain pressure after the transfer process, thereby cleaning the peripheral surface by removing residual toner and other deposits therefrom. The transport member 162 is, for example, a screw auger that collects the deposits, such as toner, removed by the cleaning plate 161 and transports the collected deposits toward a collection container (not shown). The cleaning plate 161 is, for example, a plate-shaped member (for example, a blade) made of a material such as rubber.

As illustrated in FIG. 2, the fixing device 40 includes a roller-shaped or belt-shaped heating rotating body 41 and a roller-shaped or belt-shaped pressing rotating body 42, which are disposed in a device housing 43 having an inlet and an outlet for the recording paper sheet 5. The heating rotating body 41 rotates in the direction shown by the arrow while being heated by a heater so that the surface temperature thereof is maintained at a predetermined temperature. The pressing rotating body 42 substantially extends in the axial direction of the heating rotating body 41 and rotates while being pressed against the heating rotating body 41 at a predetermined pressure. A contact portion in which the heating rotating body 41 and the pressing rotating body 42 of the fixing device 40 are in contact with each other serves as a fixing process portion (nip portion) N in which a certain fixing process (heating and pressing) is performed.

The sheet feeding device 20 is disposed below the image forming device 10 in the vertical direction Y. The sheet feeding device 20 includes at least one sheet container 22 in which the recording paper sheets 5 of the desired size and type are stacked on a stacking plate 21, and a feeding device 23 that feeds the recording paper sheets 5 one at a time from the sheet container 22. The sheet feeding device 20 is removable from the apparatus body 1*a* of the image forming apparatus 1 by holding a handle portion 24 provided on the front side of the sheet container 22 and pulling out the sheet feeding device 20.

Examples of the recording paper sheets 5 include thin paper sheets, such as sheets of normal paper and tracing paper used in electrophotographic copy machines and printers, and OHP sheets. The smoothness of the image surfaces after the fixing process may be increased by making the surfaces of the recording paper sheets 5 as smooth as possible. Accordingly, for example, sheets of coated paper obtained by coating the surface of normal paper with resin or the like and so-called cardboard paper, such as art paper for printing, having a relatively large basis weight may be used.

As illustrated in FIG. 2, a sheet transport path 32 is provided between the sheet feeding device 20 and the transfer device 15. The sheet transport path 32 is defined by one or more sheet transport roller pairs 31*a* and 31*b*, which transport each recording paper sheet 5 fed from the sheet feeding device 20 to the transfer position T, and transport guides (not shown). The sheet transport path 32 extends in the vertical direction Y along the front side of the apparatus body 1*a*, and then is bent in the X direction so as to be curved toward the inner region of the apparatus body 1*a*. The sheet transport roller pair 31*b* provided on the sheet transport path 32 at a location immediately in front of the transfer position T serves as, for example, a pair of rollers that adjust the time at which the recording paper sheet 5 is transported (registration rollers). A sheet transport path 33 that extends in the horizontal direction X is provided between the transfer device 15 and the fixing device 40. The recording paper sheet 5 fed from the transfer device 15 after the transfer process is transported to the fixing device 40 along the sheet transport path 33.

A discharge transport path 37 along which the recording paper sheet 5 is discharged to the paper discharge portion 36 through a transport roller pair 34 is located obliquely above the fixing device 40. The transport roller pair 34 is one of two transport roller pairs 34 and 35 that share a transport roller. The paper discharge portion 36 is disposed at the top of the apparatus body 1*a* in an inclined position.

A discharge roller pair 37*b* capable of discharging and reversing the recording paper sheet 5 is disposed at an outlet 37*a* of the discharge transport path 37. The rotation direction of the discharge roller pair 37*b* is switchable between forward and reverse directions.

A switching gate (not shown) that switches the transporting direction of the recording paper sheet 5 is disposed in front of the discharge roller pair 37*b*. When images are to be formed on both sides of the recording paper sheet 5, the switching gate (not shown) switches the transporting direction of the recording paper sheet 5 to the direction from the discharge transport path 37 to a double-sided-printing transport path 38. In this case, the rotation direction of the discharge roller pair 37*b* is switched from the forward (discharging) direction to the reverse direction after the trailing end of the recording paper sheet 5 transported in the discharging direction has passed the switching gate (not shown). The recording paper sheet 5 is transported in the reverse direction by the discharge roller pair 37*b*, and the switching gate (not shown) switches the transport path of the recording paper sheet 5 to a vertical transport path. Thus, the recording paper sheet 5 passes through the transport roller pair 35 and is transported to the double-sided-printing transport path 38, which extends along the back side of the apparatus body 1*a* of the image forming apparatus 1 in the vertical direction Y and is then curved so as to extend in the horizontal direction X. The double-sided-printing transport path 38 is provided with sheet transport roller pairs 39*a* and 39*b* and transport guides (not shown) that transport the recording paper sheet 5 to the sheet transport roller pair 31*b* in a reversed state.

As illustrated in FIG. 3, a toner cartridge 145 is disposed above the developing device 14. The toner cartridge 145 is an example of a developer container that contains developer containing at least toner to be supplied to the developing device 14. A toner supplying device 147 is disposed below the toner cartridge 145. The toner supplying device 147 includes a supply roller 146 that supplies the toner contained in the toner cartridge 145 to the developing device 14. A rotatable stirring transport member, such as an agitator (not shown), is disposed in the toner cartridge 145. The agitator (not shown) transports the toner contained in the toner cartridge 145 to the toner supplying device 147 while stirring the toner. The developing device 14, the agitator (not shown) disposed in the toner cartridge 145, and the toner supplying device 147 are driven by a driving force transmitted from the driving device, as described below.

Referring to FIG. 2, a control device 200 performs centralized control of the image forming apparatus 1. The control device 200 includes a central processing unit (CPU), a read only memory (ROM), a random access memory (RAM), a bus that connects the CPU, ROM, etc., and a communication interface. All of these components are not illustrated.

Process Cartridge

Figure 4:
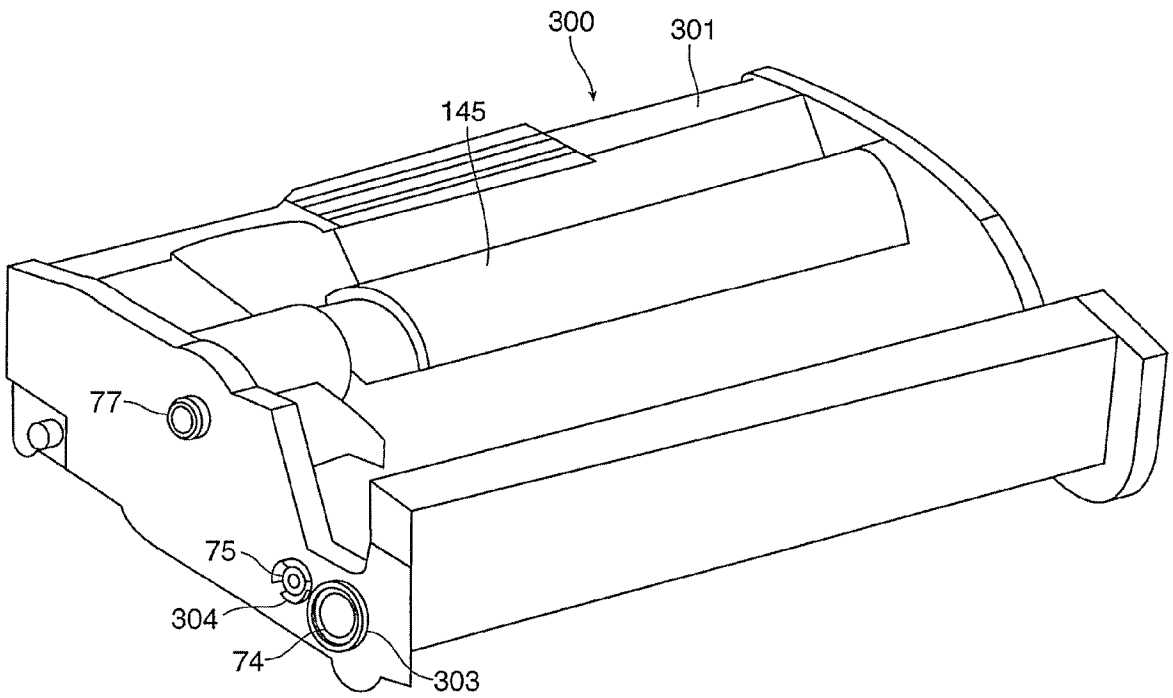
FIG. 4 is a perspective view of the image forming unit included in the image forming apparatus.

In the present exemplary embodiment, the image forming device 10 from which the exposure device 13 and the transfer device 15 are removed serves as a process cartridge 300, which is an example of an image forming unit that is removably attachable to the apparatus body 1*a* of the image forming apparatus 1. As illustrated in FIGS. 3 and 4, the process cartridge 300 includes a cartridge body 301 to which the photoconductor drum 11, the charging device 12, the developing device 14, the toner cartridge 145, and the cleaning device 16 are integrally attached. The cartridge body 301 has a concave receiving portion 302, which accommodates the toner cartridge 145 in an independently removable manner, at one end thereof. As illustrated in FIG. 4, a second photoconductor coupling 74, a second developing device coupling 75, and a second toner supply coupling 77, which are examples of a second drive transmission unit to which the driving force is transmitted from the driving device described below, are provided so as to project from one side surface of the cartridge body 301.

Figure 5:
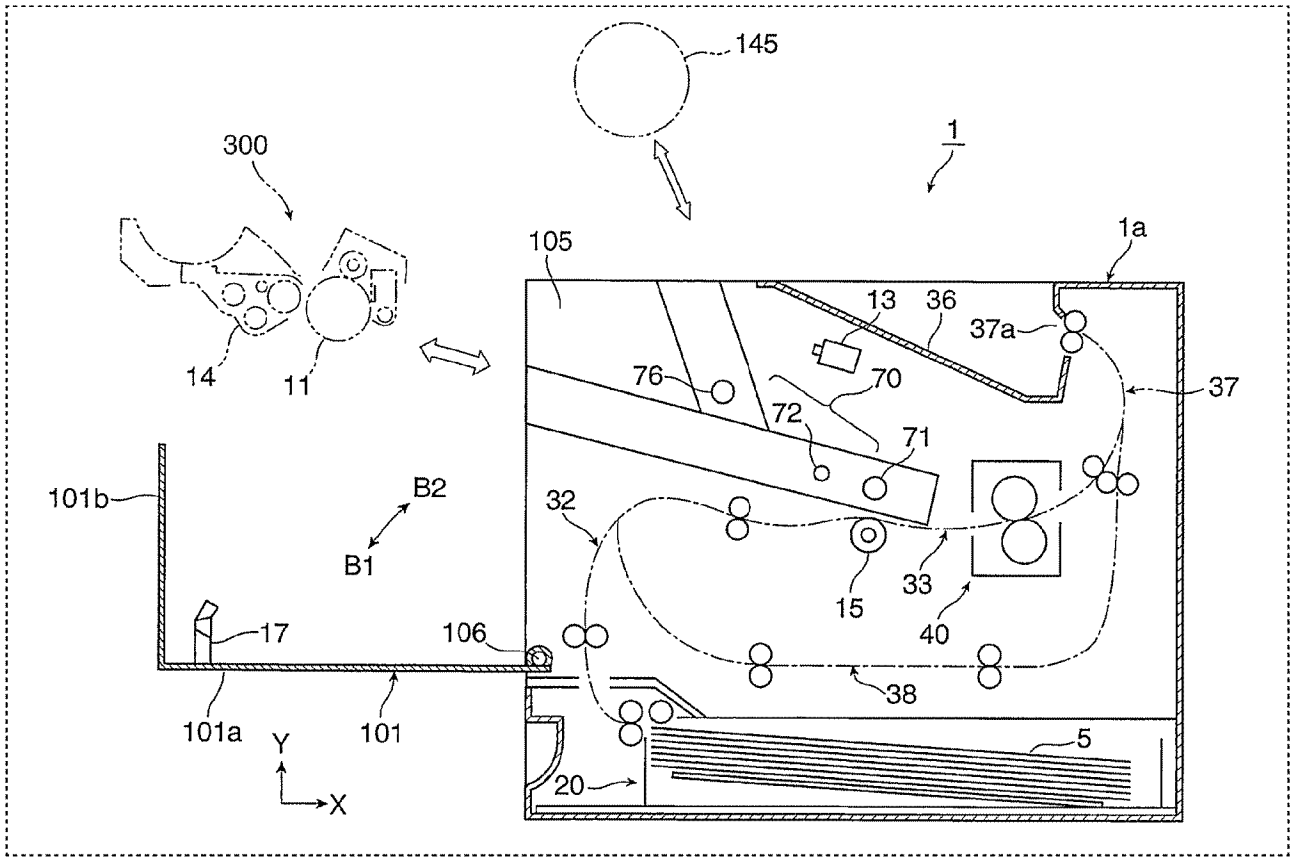
FIG. 5 is a schematic diagram illustrating the image forming apparatus incorporating the drive transmission mechanism and the driving device according to the exemplary embodiment of the present invention in such a state that a front cover is open.

As illustrated in FIGS. 2 and 5, the apparatus body 1*a* of the image forming apparatus 1 has an opening 105 at the operation side (front side) thereof at which the user operates the image forming apparatus 1. The process cartridge 300 and the toner cartridge 145 are attached to and removed from the apparatus body 1*a* through the opening 105. The front cover 101 covers and exposes the opening 105. The front cover 101 is attached to the apparatus body 1*a* in such a manner that the front cover 101 is capable of opening and closing in the directions of arrows B1 and B2 in FIGS. 2 and 5 by rotating around a rotating shaft 106 provided at the bottom end thereof. When the front cover 101 is open, transmission of the rotational driving force from the driving device, which will be described below, of the apparatus body 1*a* to the process cartridge 300 is disabled, so that the process cartridge 300 and the toner cartridge 145 are enabled to be attached to and removed from the apparatus body 1*a*. A contact operation portion 17, which transmits the opening-closing operation of the front cover 101 to the driving device (not shown), is provided at the top end of the front portion 101*a* of the front cover 101 so as to project inward.

In the present exemplary embodiment, the fixing device 40 is removably attached to the apparatus body 1*a* independently of the process cartridge 300. A rear cover (not shown) is opened and closed to enable the fixing device 40 to be removed and attached.

Basic Operation of Image Forming Apparatus

A basic image forming operation performed by the image forming apparatus 1 will now be described.

The image forming apparatus 1 is controlled by the control device 200. When the image forming apparatus 1 receives command information of a request for a monochrome image forming operation (printing) from, for example, an operation panel (not shown) attached to the apparatus body 1*a*, a user interface (not shown), or a printer driver (not shown), devices including the image forming device 10, the sheet feeding device 20, the transport device 30, and the fixing device 40 are activated.

As illustrated in FIG. 2, in the image forming device 10, the photoconductor drum 11 rotates in the direction of arrow A, and the charging device 12 charges the surface of the photoconductor drum 11 to a potential of a certain polarity (negative in the exemplary embodiment). Subsequently, the exposure device 13 irradiates the charged surface of the photoconductor drum 11 with light emitted on the basis of the image information input to the image forming apparatus 1. Thus, an electrostatic latent image having a certain potential difference is formed on the surface of the photoconductor drum 11.

Subsequently, the developing device 14 develops the electrostatic latent image formed on the photoconductor drum 11 by supplying black toner, which is charged to a certain polarity (negative polarity), from the developing roller 141 and causing the black toner to electrostatically adhere to the photoconductor drum 11. Accordingly, the electrostatic latent image formed on the photoconductor drum 11 is developed into a visible toner image by using the black toner. The toner is supplied from the toner cartridge 145 to the developing device 14 of the process cartridge 300 through the toner supplying device 147 at a certain timing.

Subsequently, when the toner image formed on the photoconductor drum 11 reaches the transfer position, the transfer device 15 transfers the toner image to the recording paper sheet 5.

After the transfer process, the drum cleaning device 16 of the image forming device 10 cleans the surface of the photoconductor drum 11 by scraping off deposits therefrom. Thus, the image forming device 10 is made ready for the next image forming operation.

The sheet feeding device 20 feeds the recording paper sheet 5 to the sheet transport path 32 in accordance with the image forming operation. The sheet transport roller pair 31*b*, which is a pair of registration rollers, transports the recording paper sheet 5 to the transfer position along the sheet transport path 32 in accordance with the transfer time.

Subsequently, the recording paper sheet 5 to which the toner image has been transferred is transported to the fixing device 40 along the sheet transport path 33. The fixing device 40 causes the recording paper sheet 5 that has been subjected to the transfer process to pass through the fixing process portion N between the heating rotating body 41 and the pressing rotating body 42 that rotate, and fixes the unfixed toner image to the recording paper sheet 5 by performing a necessary fixing process (heating and pressing). When an image is to be formed only on one side of the recording paper sheet 5 in the image forming operation, the recording paper sheet 5 that has been subjected to the fixing process is discharged along the discharge transport path 37 to the paper discharge portion 36 at the top of the apparatus body 1*a* by the discharge roller pair 37*b*.

When images are to be formed on both sides of the recording paper sheet 5, the switching gate (not shown) causes the recording paper sheet 5 on which an image is formed on one side thereof to be transported to the discharge roller pair 37*b*, and the recording paper sheet 5 is temporarily transported in the discharging direction by the discharge roller pair 37*b*. After that, the rotation direction of the discharge roller pair 37*b* is reversed while the trailing end of the recording paper sheet 5 is clamped by the discharge roller pair 37*b*, so that the recording paper sheet 5 is reversed and transported to the transfer device 15 again along the double-sided-printing transport path 38. Then, a toner image is transferred to the back side of the recording paper sheet 5. After the toner image is transferred to the back side of the recording paper sheet 5, the recording paper sheet 5 is transported to the fixing device 40 along the sheet transport path 33, and is subjected to the fixing process (heating and pressing) by the fixing device 40. Then, the recording paper sheet 5 is discharged to the paper discharge portion 36 by the discharge roller pair 37*b*.

The recording paper sheet 5 on which a monochrome image is formed is output by the above-described operation.

In the image forming apparatus 1, the toner contained in the toner cartridge 145 is consumed in the image forming operation. When the toner cartridge 145 becomes empty or nearly empty, the toner cartridge 145 is replaced with a new toner cartridge 145. In addition, in the image forming apparatus 1, the photoconductor drum 11 of the process cartridge 300, for example, wears during the image forming operation. When, for example, the photoconductor drum 11 reaches the end of its service life, the process cartridge 300 is replaced with a new process cartridge 300.

The process cartridge 300 and the toner cartridge 145 are replaced while the front cover 101 of the image forming apparatus 1 is open. Therefore, the driving device that drives the process cartridge 300 and the toner cartridge 145 is configured such that transmission of the rotational driving force therefrom is disabled (blocked) in response to the opening operation of the front cover 101.

Structures of Drive Transmission Mechanism and Driving Device

Figure 6:
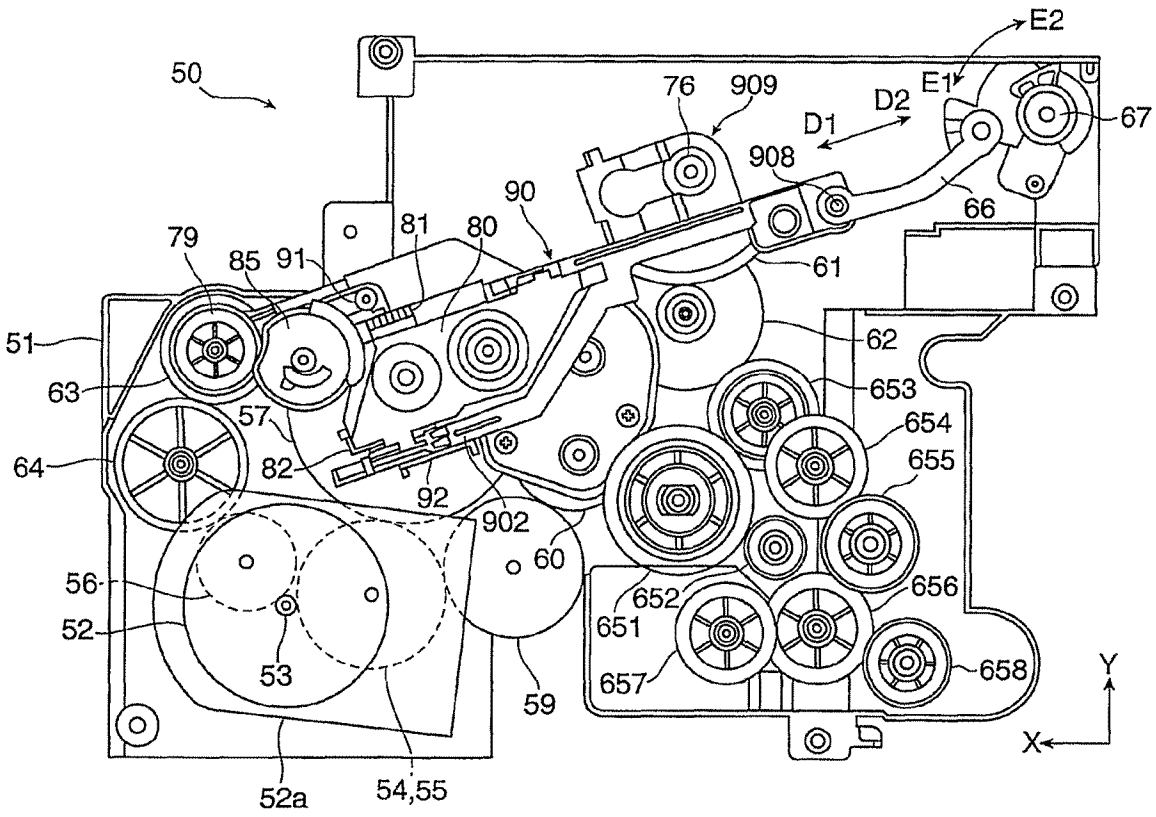
FIG. 6 illustrates the driving device incorporating the drive transmission mechanism according to the exemplary embodiment of the present invention.

FIG. 6 illustrates a driving device 50 incorporating a drive transmission mechanism 70 according to the exemplary embodiment.

Referring to FIG. 1, the driving device 50 is attached to an inner surface of the outer cover 104 at one side (right side in the illustrated example) of the apparatus body 1*a* of the image forming apparatus 1. As illustrated in FIG. 6, the driving device 50 includes a device board 51 that stands in the vertical direction Y along one side of the apparatus body 1*a*. The device board 51 has the shape of a substantially rectangular flat plate with its upper left corner cut off in front view. A drive motor 52, which is an example of a drive source, is attached to the bottom portion of the device board 51 at one end thereof (left end in the illustrated example). The drive motor 52 is driven at a certain speed by a drive circuit (not shown) mounted on a drive board 52*a* under the control of the control device 200. The drive motor 52 rotationally drives the image forming portions, which include the photoconductor drum 11, the developing device 14, the toner cartridge 145, the sheet feeding device 20, the transport device 30, and the fixing device 40, of the image forming apparatus 1.

A driving gear 53, which is a helical gear, for example, is integrated with a rotating shaft of the drive motor 52. The driving gear 53 of the drive motor 52 meshes with a first transmission gear 54 and a second transmission gear 55. The first transmission gear 54 transmits the rotational driving force only to the photoconductor drum 11 of the process cartridge 300. The second transmission gear 55 transmits the rotational driving force to the developing device 14 of the process cartridge 300, to the toner cartridge 145, and to the sheet feeding device 20 and the transport device 30 on the apparatus body 1*a*. The first and second transmission gears 54 and 55 are two helical gears having the same outer diameter that are coaxially arranged at different positions in the axial direction and that are independently rotatable. In the illustrated example, the first transmission gear 54 is disposed behind the second transmission gear 55 in the axial direction. The driving gear 53 of the drive motor 52 also meshes with a third transmission gear 56 that transmits the rotational driving force to the fixing device 40 on the apparatus body 1*a*.

A photoconductor driving gear 57, which is an example of a driving unit that rotationally drives the photoconductor drum 11, is disposed on the device board 51 at a position corresponding to one end portion of the photoconductor drum 11 attached to the process cartridge 300 in the axial direction. The photoconductor driving gear 57 directly meshes with the first transmission gear 54 and receives a rotational driving force. The photoconductor drum 11 has a relatively large outer diameter among the image forming portions. When the process speed of the image forming apparatus 1 is constant, the photoconductor driving gear 57 that rotationally drives the photoconductor drum 11 having a relatively large outer diameter has a low rotational speed. Therefore, the photoconductor driving gear 57 has an outer diameter greater than those of the transmission gears 54 and 55.

Figure 7:
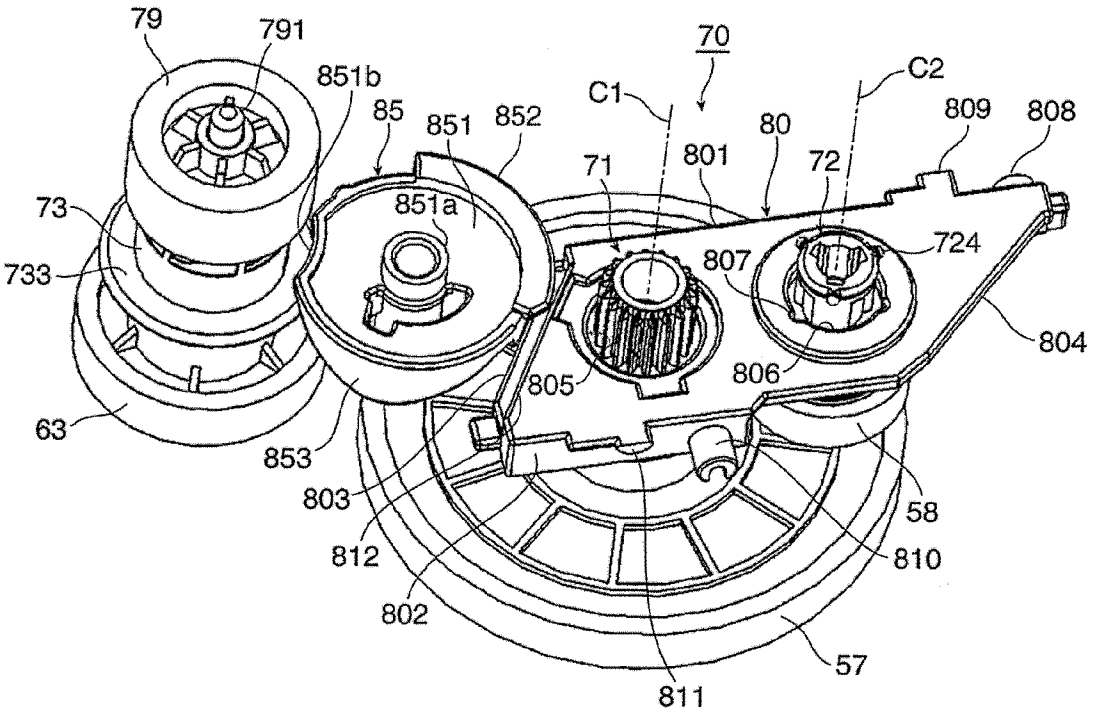
FIG. 7 is a perspective view of a portion of the driving device incorporating the drive transmission mechanism according to the exemplary embodiment of the present invention.

As illustrated in FIG. 7, a developing device driving gear 58, which is an example of a driving unit that rotationally drives components including the developing roller 141, is disposed on one side of the photoconductor driving gear 57 (side facing the inner region of the apparatus body 1*a*) at a position corresponding to one end portion of the developing roller 141 of the developing device 14 attached to the process cartridge 300 in the axial direction. As illustrated in FIG. 6, the developing device driving gear 58 receives a rotational driving force from the second transmission gear 55 through intermediate gears 59 and 60. As described above, the photoconductor driving gear 57 has an outer diameter greater than those of the transmission gears 54 and 55. The center-to-center distance between the photoconductor driving gear 57 and the developing device driving gear 58 is uniquely determined by the outer diameters of the photoconductor drum 11 and the developing roller 141. Therefore, in the illustrated exemplary embodiment, the photoconductor driving gear 57 and the developing device driving gear 58 are not arranged on the same plane, and the developing device driving gear 58 is disposed on one side of the photoconductor driving gear 57. The developing device driving gear 58 is disposed on the same plane (meshing plane) as the second transmission gear 55 and the intermediate gears 59 and 60 (meshing plane) in front of the photoconductor driving gear 57 in the axial direction in FIG. 7.

The photoconductor driving gear 57 and the developing device driving gear 58 are arranged so that two rotation axes C1 and C2 thereof, which are rotation centers, are adjacent to each other with the distance therebetween corresponding to the center-to-center distance between the photoconductor drum 11 and the developing roller 141. The rotation axes C1 and C2 of the photoconductor driving gear 57 and the developing device driving gear 58, respectively, are rotation centers of the photoconductor driving gear 57 and the developing device driving gear 58 and are not rotating shafts.

As illustrated in FIG. 6, a toner supply driving gear 61, which is an example of a driving unit that rotationally drives the agitator (not shown) of the toner cartridge 145, is disposed on an upper central portion of the device board 51 at a position corresponding to one end portion of the agitator (not shown) of the toner cartridge 145 in the axial direction. The toner supply driving gear 61 receives a rotational driving force from the second transmission gear 55 through intermediate gears 59, 60, and 62, some of which are shared by the developing device 14.

A fixing device driving gear 63, which is an example of a driving unit that rotationally drives the heating rotating body 41 of the fixing device 40, is disposed on a left end portion of the device board 51 at a position corresponding to one end portion of the heating rotating body 41 of the fixing device 40 in the axial direction. The fixing device driving gear 63 receives a rotational driving force from the driving gear 53 of the drive motor 52 through the third transmission gear 56 and an intermediate gear 64.

The sheet feeding device 20 and the transport device 30 disposed in the apparatus body 1*a* of the image forming apparatus 1 receive a rotational driving force from the driving gear 53 of the drive motor 52 through the second transmission gear 55 and plural intermediate gears 59, 60, 62, and 651 to 658 (including driving gears that drive the sheet feeding device 20 and the transport device 30), some of which are shared by devices such as the developing device 14.

Referring to FIG. 5, when the process cartridge 300 and the toner cartridge 145, which are removably attachable to the apparatus body 1*a* of the image forming apparatus 1, are attached to the apparatus body 1*a* at certain positions, the photoconductor drum 11 and the developing device 14 of the process cartridge 300 and the toner cartridge 145 respectively receive the rotational driving force from the photoconductor driving gear 57, the developing device driving gear 58, and the toner supply driving gear 61 on the apparatus body 1*a* through the drive transmission mechanism 70. The drive transmission mechanism 70 is configured to switch between a state in which the transmission of the rotational driving force from the photoconductor driving gear 57, the developing device driving gear 58, and the toner supply driving gear 61 is enabled and a state in which that transmission of the rotational driving force is disabled (blocked) in response to the opening-closing operation of the front cover 101 of the image forming apparatus 1. The front cover 101 is opened and closed when the process cartridge 300 and the toner cartridge 145 are attached to and removed from the apparatus body 1*a*.

As illustrated in FIG. 7, the drive transmission mechanism 70 includes a first photoconductor coupling 71 and a first developing device coupling 72 as examples of plural first drive transmission units arranged to be movable in the axial directions (the same direction) of plural (two) adjacent rotation axes C1 and C2 of the photoconductor driving gear 57 and the developing device driving gear 58. The drive transmission mechanism 70 also includes a first fixing device coupling 73 as an example of a first drive transmission unit arranged to be movable in the axial direction of the fixing device driving gear 63.

Figure 8:
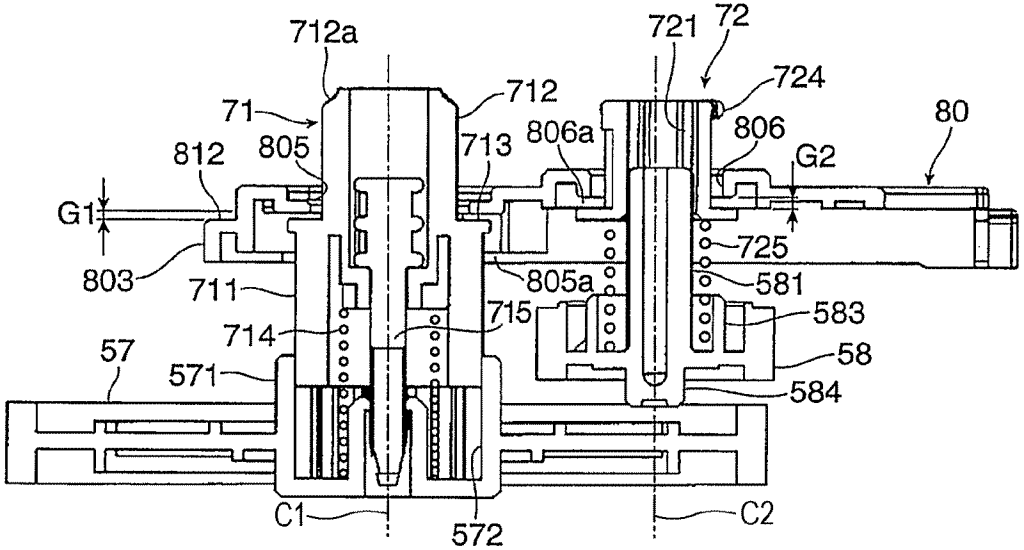
FIG. 8 is a sectional view of the portion of the driving device incorporating the drive transmission mechanism according to the exemplary embodiment of the present invention.
Figure 9:
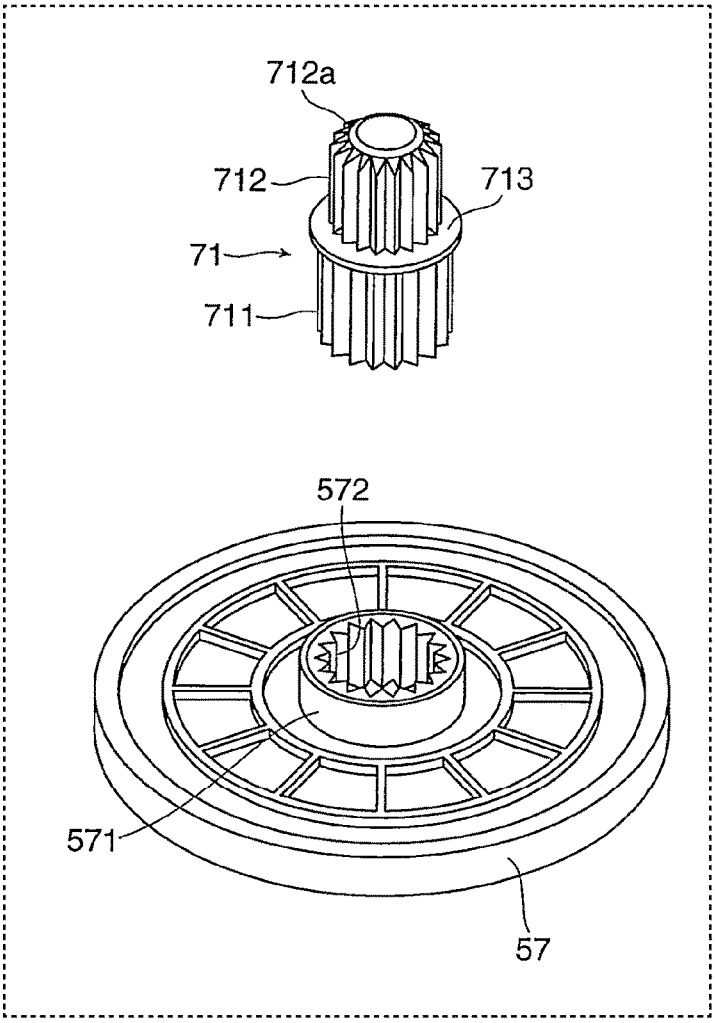
FIG. 9 is a perspective view of a photoconductor driving gear and a first photoconductor coupling.

As illustrated in FIG. 8, the photoconductor driving gear 57 integrally includes a hollow cylindrical core portion 571 that projects from one side of the photoconductor driving gear 57 at the center thereof. The first photoconductor coupling 71 is attached to the core portion 571 such that the first photoconductor coupling 71 is movable in the rotation axis C1 on one side of the photoconductor driving gear 57. As illustrated in FIG. 9, the first photoconductor coupling 71 integrally includes a first gear portion 711, which is hollow-cylindrical and has an involute spur gear at the outer periphery thereof, and a second gear portion 712, which is also hollow-cylindrical and has an involute spur gear at the outer periphery thereof and whose outer diameter is smaller than that of the first gear portion 711. The second gear portion 712 includes a tapered portion 712*a* at an end thereof. The first photoconductor coupling 71 also includes a first contact portion 713 having an annular shape that extends radially outward between the first gear portion 711 and the second gear portion 712.

Figure 11:
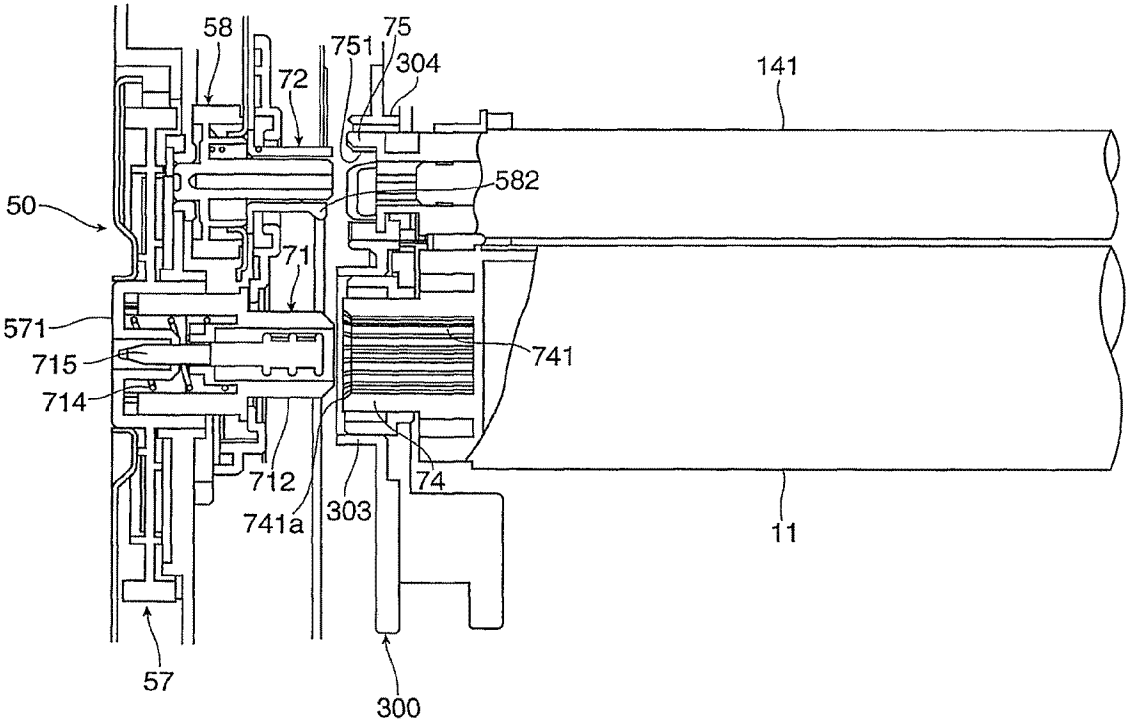
FIG. 11 is a sectional view of a portion of the image forming apparatus incorporating the driving device according to the exemplary embodiment of the present invention in a disengaged state.

The core portion 571 of the photoconductor driving gear 57 has an internal gear 572, which is an involute spur gear that meshes with the first gear portion 711 of the first photoconductor coupling 71. The first photoconductor coupling 71 is movable in the axial direction in such a state that the first gear portion 711 meshes with the internal gear 572 of the photoconductor driving gear 57 and the rotational driving force is transmitted thereto. As illustrated in FIGS. 4 and 11, the second gear portion 712 of the first photoconductor coupling 71 is capable of meshing (engaging) with and disengaging from the second photoconductor coupling 74 (see FIG. 11), which is an example of a second drive transmission unit provided on one end portion of the photoconductor drum 11 of the process cartridge 300 in the axial direction. The second photoconductor coupling 74 is hollow-cylindrical and has an internal gear 741 (see FIG. 11), which is an involute spur gear that meshes with the second gear portion 712 of the first photoconductor coupling 71, at the inner periphery thereof. The internal gear 741 has a flared portion 741*a* (see FIG. 11) at an opening end thereof, the flared portion 741*a* having a diameter that increases toward the opening end. The second photoconductor coupling 74 is fixed to one end portion of the photoconductor drum 11 in the axial direction. The process cartridge 300 has a hollow cylindrical protecting member 303 (see FIG. 11) that projects from a side surface thereof to protect the second photoconductor coupling 74 at the outer periphery of the second photoconductor coupling 74.

It is not necessary that the first photoconductor coupling 71 include the first and second gear portions 711 and 712 having involute gears. However, the photoconductor drum 11, which receives the rotational driving force through the first photoconductor coupling 71, directly affects the image quality, and it is therefore desirable that the photoconductor drum 11 is accurately rotated with, for example, small speed variation. The first photoconductor coupling 71 including the first and second gear portions 711 and 712 having involute gears is capable of transmitting the rotational driving force to the photoconductor drum 11 so as to enable relatively accurate rotation of the photoconductor drum 11, and is therefore suitable.

As illustrated in FIG. 8, the first photoconductor coupling 71 is urged in a projecting direction by a first coil spring 714, which is an example of a first urging unit disposed between an inner end surface of the core portion 571 of the photoconductor driving gear 57 and an inner end surface of the first gear portion 711. The amount of projection of the first photoconductor coupling 71 in the axial direction of the photoconductor driving gear 57 is restricted by a fixing shaft 715 attached to the core portion 571 of the photoconductor driving gear 57.

Figure 10:
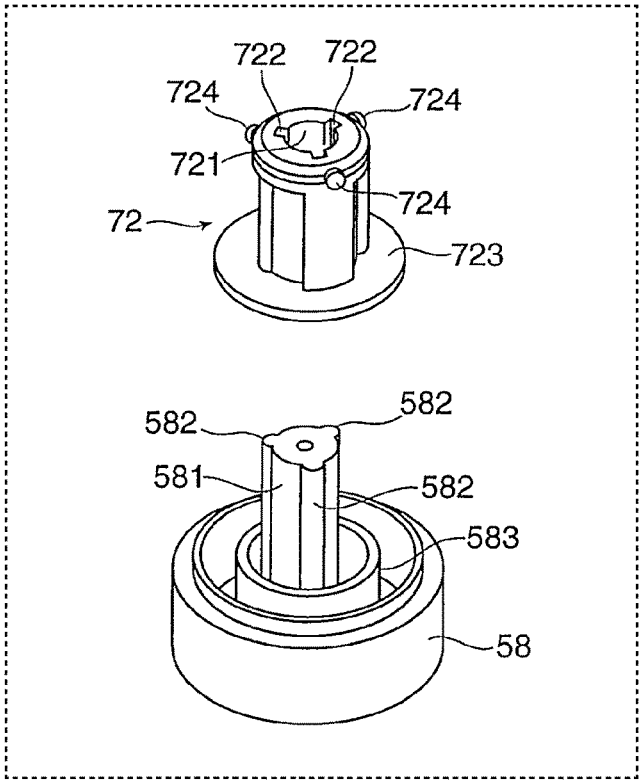
FIG. 10 is a perspective view of a developing device driving gear and a first developing device coupling.

As illustrated in FIG. 8, the first developing device coupling 72 is attached to the developing device driving gear 58 such that the first developing device coupling 72 is movable in an axial direction of the rotation axis C2. As illustrated in FIG. 10, a substantially solid or hollow cylindrical driving-force-transmitting shaft 581 is integrated with the developing device driving gear 58 so as to project from one side of the developing device driving gear 58 in the axial direction. Plural first projections 582 (three first projections in the illustrated example) having a substantially semicircular cross section are integrally formed on the outer periphery of the driving-force-transmitting shaft 581 and arranged in the circumferential direction. The three first projections 582 are disposed on the outer periphery of the driving-force-transmitting shaft 581 at angular positions that are 120 degrees apart from each other. Each first projection 582 extends over the entire length of the driving-force-transmitting shaft 581 in the axial direction. A first shaft support portion 583 having a hollow cylindrical shape is formed on the developing device driving gear 58 at the outer periphery of the driving-force-transmitting shaft 581. A second shaft support portion 584 (see FIG. 8) having a hollow cylindrical shape with a diameter smaller than that of the first shaft support portion 583 is provided on the developing device driving gear 58 at the side opposite to the side at which the driving-force-transmitting shaft 581 is provided. The first shaft support portion 583 has a length that is substantially equal to the length (thickness) of the developing device driving gear 58 in the axial direction.

The first developing device coupling 72 is substantially hollow-cylindrical. The first developing device coupling 72 has an attachment hole 721 having plural first recesses 722, which engage with the first projections 582 on the driving-force-transmitting shaft 581, in the inner peripheral surface thereof. The first developing device coupling 72 integrally includes a second contact portion 723 having an annular shape that projects radially outward at the base end thereof. Plural second projections 724 (three second projections in the illustrated example) having a substantially hemispherical shape are integrally formed on an end portion of the first developing device coupling 72 so as to project outward and arranged in the circumferential direction. Each second projection 724 is disposed at the same position as one of the first projections 582 on the developing device driving gear 58 in the circumferential direction of the first developing device coupling 72.

Figure 12:
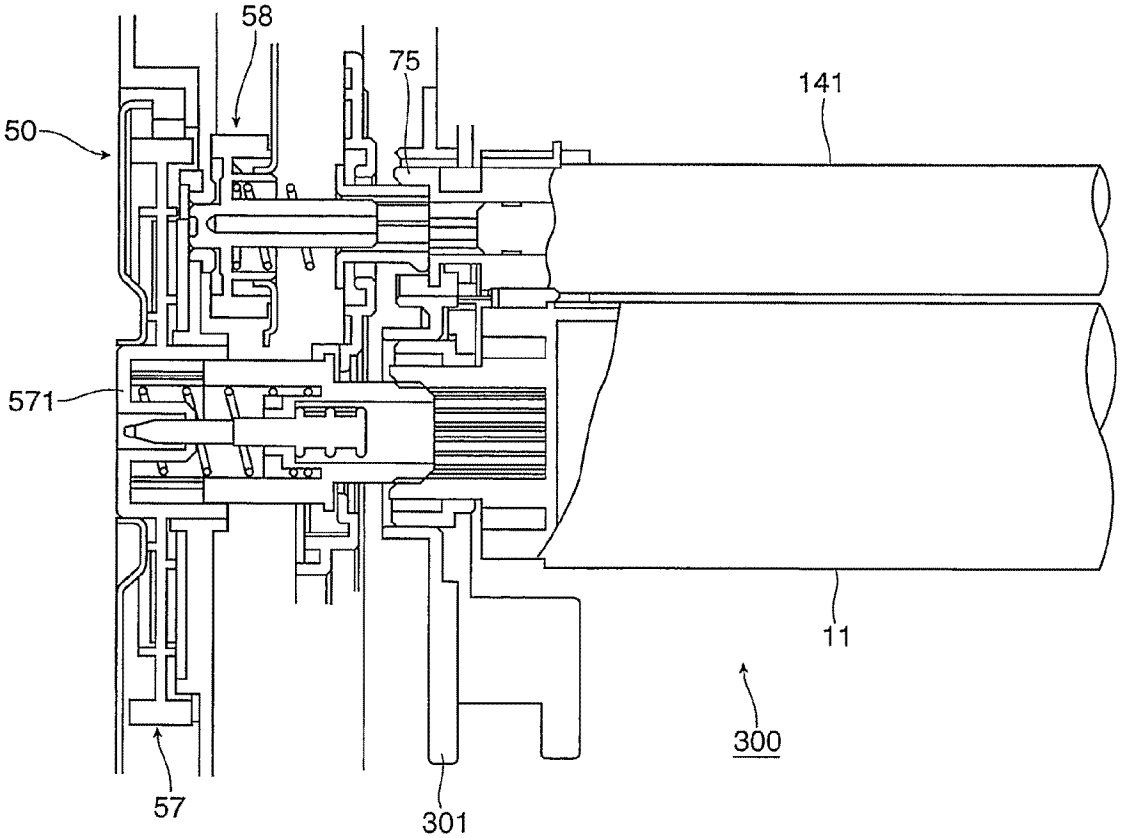
FIG. 12 is a sectional view of the portion of the image forming apparatus incorporating the driving device according to the exemplary embodiment of the present invention in an engaged state.

As illustrated in FIGS. 4 and 11, the second projections 724 on the first developing device coupling 72 are capable of meshing (engaging) with and disengaging from the second developing device coupling 75, which is an example of a second drive transmission unit provided on one end portion of the developing roller 141 of the process cartridge 300 in the axial direction. The second developing device coupling 75 has plural second recesses 751, which engage with the second projections 724 on the first developing device coupling 72, in the inner peripheral surface thereof. As illustrated in FIG. 8, the first developing device coupling 72 is urged in a projecting direction by a second coil spring 725, which is an example of a second urging unit disposed between an end surface of the developing device driving gear 58 and a bottom end surface of the second contact portion 723. As illustrated in FIG. 12, the first developing device coupling 72 is rotatable in such a state that the first developing device coupling 72 is in contact with the second developing device coupling 75 of the developing roller 141 and that the projecting position thereof is restricted. The process cartridge 300 has a protecting member 304 that projects from a side surface thereof to protect the second developing device coupling 75 at the outer periphery of the second developing device coupling 75. The first developing device coupling 72 may be configured so that the projecting position thereof is restricted by a restricting member (not shown).

Figure 13A:
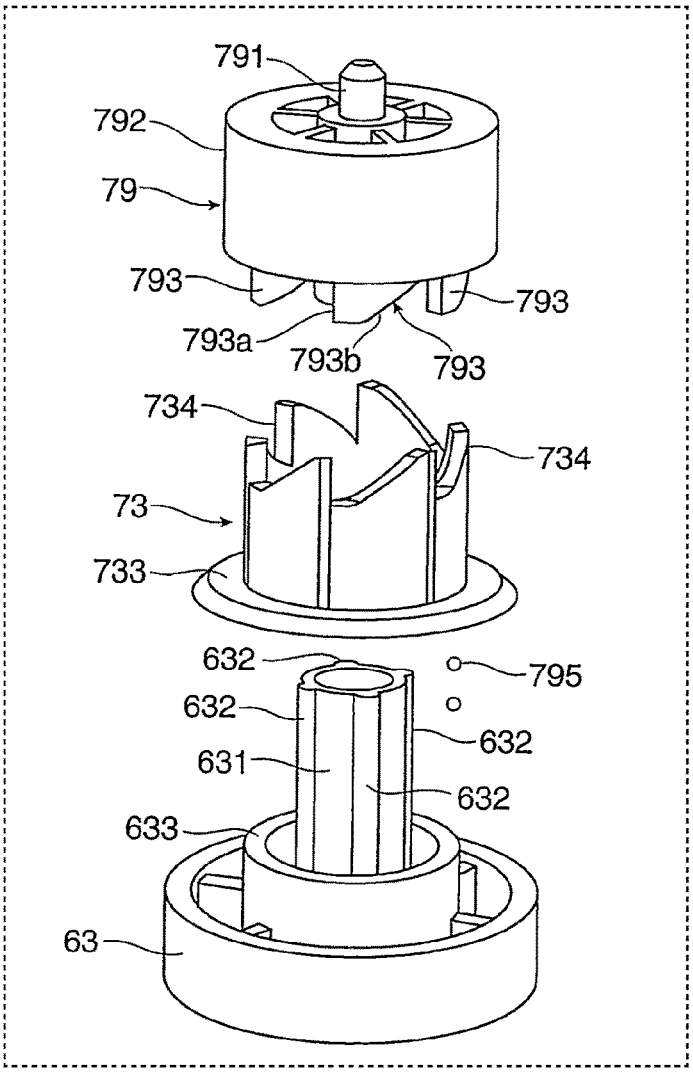
FIGS. 13A and 13B are perspective views of a fixing device driving gear and first and second fixing device couplings.

As illustrated in FIG. 7, the first fixing device coupling 73, which is an example of a first drive transmission unit, is attached to the fixing device driving gear 63 such that the first fixing device coupling 73 is movable in the axial direction. As illustrated in FIG. 13A, a hollow cylindrical driving-force-transmitting shaft 631 is integrated with the fixing device driving gear 63 so as to project from one side of the fixing device driving gear 63 in the axial direction. Plural third projections 632 (four projections in the illustrated example) having a substantially semicircular cross section are integrally formed on the outer periphery of the driving-force-transmitting shaft 631 and arranged in the circumferential direction. The four third projections 632 are disposed on the outer periphery of the driving-force-transmitting shaft 631 at angular positions that are 90 degrees apart from each other. Each third projection 632 extends over the entire length of the driving-force-transmitting shaft 631 in the axial direction. A shaft support portion 633 having a hollow cylindrical shape is formed on the fixing device driving gear 63 at the outer periphery of the driving-force-transmitting shaft 631.

Figure 13B:
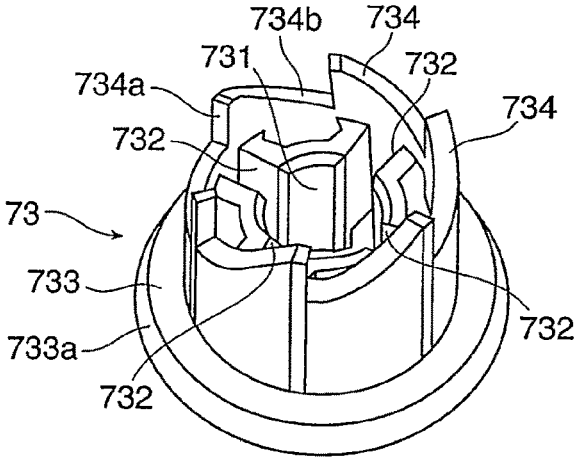

As illustrated in FIG. 13B, the first fixing device coupling 73 has a substantially double hollow cylindrical shape. The first fixing device coupling 73 has an attachment hole 731 having plural third recesses 732, which engage with the third projections 632 on the driving-force-transmitting shaft 631, in the inner peripheral surface thereof. The first fixing device coupling 73 integrally includes a third contact portion 733 having an annular shape that projects radially outward at the base end thereof. The third contact portion 733 has an inclined surface 733*a* that is inclined downward toward the outer periphery. Plural engagement portions 734 (six engagement portions in the illustrated example) are integrally formed on an end portion of the first fixing device coupling 73 and arranged in the circumferential direction of the first fixing device coupling 73. Each engagement portion 734 has a substantially right triangular shape in side view and includes a flat surface 734*a* that extends in the axial direction and an inclined surface 734*b* that is inclined from an end of the flat surface 734*a* toward the base end.

As illustrated in FIG. 13A, the engagement portions 734 of the first fixing device coupling 73 are capable of meshing (engaging) with and disengaging from a second fixing device coupling 79, which is an example of a second drive transmission unit and which is rotatable around a rotating shaft 791 arranged to project from the device board 51 of the driving device 50. The second fixing device coupling 79 includes a gear having a gear portion 792 on the outer peripheral surface thereof. The second fixing device coupling 79 meshes with a driving gear provided on one end portion of the heating rotating body 41 of the fixing device 40 in the axial direction to transmit the rotational driving force. Plural second engagement portions 793 (six second engagement portions in the illustrated example) that engage with the first engagement portions 734 of the first fixing device coupling 73 are provided on one end portion of the second fixing device coupling 79 in the axial direction. The second engagement portions 793 are shaped to be engageable with the engagement portions 734 of the first fixing device coupling 73. Each engagement portion 793 has a substantially right triangular shape in side view and includes a flat surface 793*a* that extends in the axial direction and an inclined surface 793*b* that is inclined from an end of the flat surface 793*a* toward the base end. The first fixing device coupling 73 is urged in a projecting direction by a third coil spring 795, which is an example of a third urging unit disposed between an end surface of the fixing device driving gear 63 and a bottom end surface of the third contact portion 733.

Figure 14:
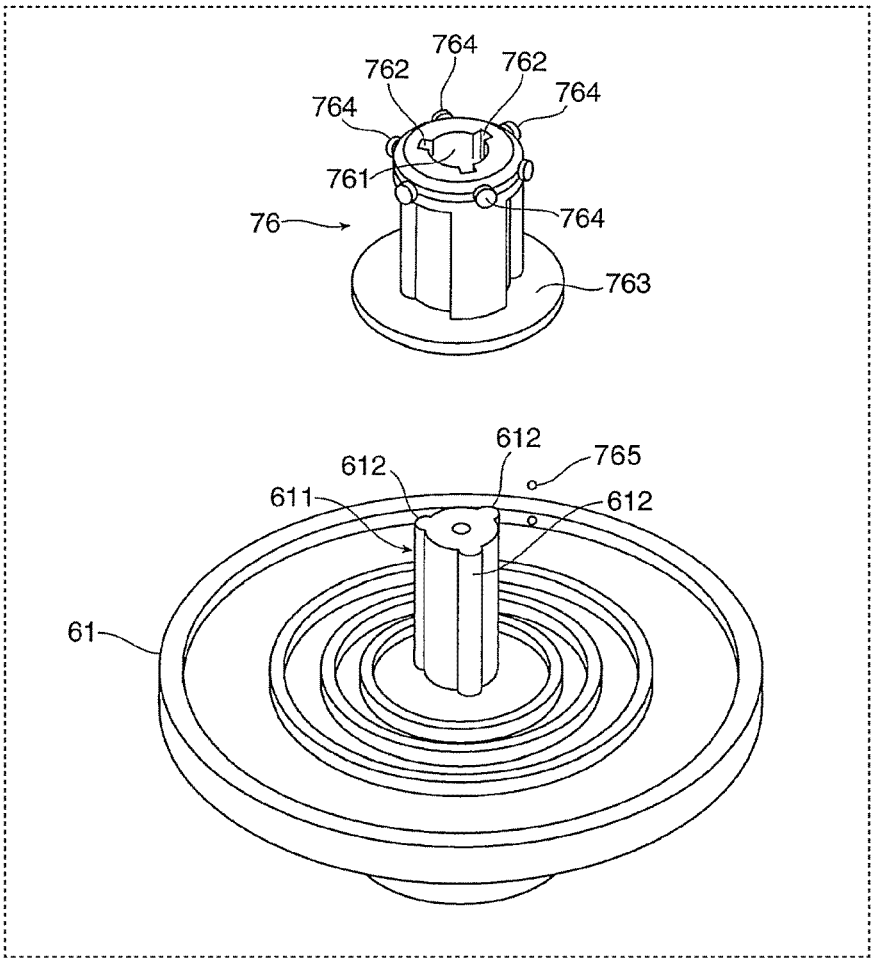
FIG. 14 is a perspective view of a toner supply driving gear and a first toner supply coupling.

As illustrated in FIG. 14, a first toner supply coupling 76, which is an example of a first drive transmission unit, is attached to the toner supply driving gear 61 such that the first toner supply coupling 76 is movable in the axial direction. A driving-force-transmitting shaft 611 is integrated with the toner supply driving gear 61 so as to project from one side of the toner supply driving gear 61 in the axial direction. Plural fourth projections 612 (three fourth projections in the illustrated example) having a substantially semicircular cross section are integrally formed on the outer periphery of the driving-force-transmitting shaft 611 and arranged in the circumferential direction. The three fourth projections 612 are disposed on the outer periphery of the driving-force-transmitting shaft 611 at angular positions that are 120 degrees apart from each other. Each fourth projection 612 extends over the entire length of the driving-force-transmitting shaft 611 in the axial direction.

The first toner supply coupling 76 is substantially hollow-cylindrical. The first toner supply coupling 76 has an attachment hole 761 having plural fourth recesses 762, which engage with the fourth projections 612 on the driving-force-transmitting shaft 611, in the inner peripheral surface thereof. The first toner supply coupling 76 integrally includes a fourth contact portion 763 having an annular shape that projects radially outward at the base end thereof. Plural fifth projections 764 (six fifth projections in the illustrated example) having a substantially hemispherical shape are integrally formed on an end portion of the first toner supply coupling 76 so as to project outward and arranged in the circumferential direction. Similar to the first photoconductor coupling 71, the first toner supply coupling 76 may have a hollow cylindrical shape and include first and second gear portions.

Figure 15:
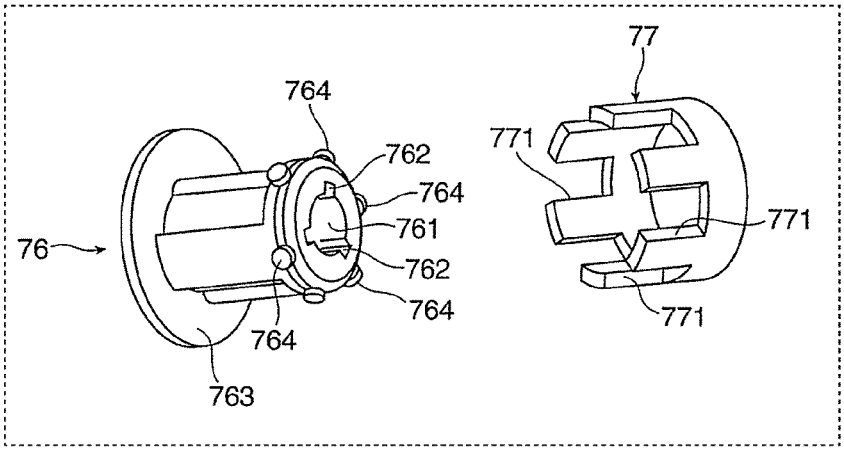
FIG. 15 is a perspective view of the first toner supply coupling and a second toner supply coupling.

As illustrated in FIG. 15, the fifth projections 764 on the first toner supply coupling 76 are capable of meshing (engaging) with and disengaging from the second toner supply coupling 77, which is an example of a second drive transmission unit provided on one end portion of the agitator (not shown) of the toner cartridge 145 in the axial direction. The second toner supply coupling 77 has plural fifth recesses 771 arranged in the circumferential direction thereof. The fifth recesses 771 engage with the fifth projections 764 on the first toner supply coupling 76. As illustrated in FIG. 14, the first toner supply coupling 76 is urged in a projecting direction by a fourth coil spring 765, which is an example of a fourth urging unit disposed between an end surface of the toner supply driving gear 61 and a bottom end surface of the fourth contact portion 763.

Coupling Retracting Member (Switching Unit)

As illustrated in FIG. 6, the drive transmission mechanism 70 includes a coupling retracting member 80 as an example of a switching unit capable of moving in the axial direction with respect to the device board 51 without moving in a direction crossing the axial direction. The coupling retracting member 80 moves the first photoconductor coupling 71 and the first developing device coupling 72 in the axial direction of the rotation axes C1 and C2 to switch between a state in which transmission of the rotational driving force to the second photoconductor coupling 74 and the second developing device coupling 75 on the process cartridge 300 is enabled and a state in which the transmission of the rotational driving force is disabled.

The drive transmission mechanism 70 also includes a rotating cam 85 as an example of a switching unit. The rotating cam 85 is disposed such that the position thereof with respect to the device board 51 in a direction crossing the axial direction does not change, and moves the first fixing device coupling 73 in the axial direction to switch between a state in which transmission of the rotational driving force to the second fixing device coupling 79 on the apparatus body 1*a* is enabled and a state in which the transmission of the rotational driving force is disabled. As described below, the rotating cam 85 also has a function of assisting the movement of the coupling retracting member 80 in the axial direction.

As illustrated in FIG. 7, the coupling retracting member 80 is a plate-shaped member that is substantially parallelogram-shaped in front view. The coupling retracting member 80 includes a top end surface 801 and a bottom end surface 802 that are bent rearward along the top and bottom edges, a left side surface 803, and a right side surface 804. The left side surface 803 extends between the left end portions of the top end surface 801 and the bottom end surface 802 so as to form an obtuse angle at the left end portion of the top end surface 801. The right side surface 804 extends between the right end portions of the top end surface 801 and the bottom end surface 802, and is inclined in the same direction as the left side surface 803 by an angle greater than the left side surface 803. The coupling retracting member 80 is formed so that the right end region of the bottom end surface 802 and the entire region of the right side surface 804 are open to prevent interference with a casing (not shown) that supports the developing device driving gear 58 and other components in a rotatable manner. As illustrated in FIG. 6, the coupling retracting member 80 is installed such that the coupling retracting member 80 is movable only in a direction crossing the surface of the device board 51 (axial direction) along guide members 81 and 82 arranged to project from the device board 51. The guide members 81 and 82 are respectively provided at positions corresponding to the left end portion of the top end surface 801 of the coupling retracting member 80 and the left end portion of the bottom end surface 802 of the coupling retracting member 80.

As illustrated in FIG. 7, the coupling retracting member 80 has two circular through holes 805 and 806 in a substantially central area thereof. The through holes 805 and 806 respectively allow the second gear portion 712 of the first photoconductor coupling 71 and the first developing device coupling 72 to extend therethrough, and are arranged adjacent to each other with the distance therebetween being equal to the center-to-center distance between the rotation axes C1 and C2 of the photoconductor driving gear 57 and the developing device driving gear 58. As illustrated in FIG. 8, the inner diameters of the two through holes 805 and 806 are greater than the outer diameters of the second gear portion 712 of the first photoconductor coupling 71 and the first developing device coupling 72, and are less than the outer diameters of the first and second contact portions 713 and 723 of the first photoconductor coupling 71 and the first developing device coupling 72. Plural recesses 807 that receive the projections 724 on the first developing device coupling 72 are formed in the inner peripheral surface of the through hole 806. The two through holes 805 and 806 are configured to come into contact with the first and second contact portions 713 and 723 of the first photoconductor coupling 71 and the first developing device coupling 72 to press the first photoconductor coupling 71 and the first developing device coupling 72 downward at different times, thereby reducing the operating force for moving the coupling retracting member 80.

More specifically, as illustrated in FIG. 8, the two through holes 805 and 806 in the coupling retracting member 80 are formed so that bottom end surfaces 805*a* and 806*a* thereof are at different positions in the axial direction. In the illustrated exemplary embodiment, a gap G1 between the bottom end surface 805*a* of the through hole 805 and the first contact portion 713 of the first photoconductor coupling 71 in the axial direction is smaller than a gap G2 between the bottom end surface 806*a* of the through hole 806 and the second contact portion 723 of the first developing device coupling 72 in the axial direction (G1<G2). FIG. 8 illustrates the state in which the coupling retracting member 80 has been moved to a driving position and in which the first photoconductor coupling 71 and the first developing device coupling 72 are respectively engaged with the second photoconductor coupling 74 and the second developing device coupling 75. Referring to FIG. 8, when the coupling retracting member 80 is moved downward, first, the bottom end surface 805*a* of the through hole 805 in the coupling retracting member 80 comes into contact with the first contact portion 713 of the first photoconductor coupling 71, and then the bottom end surface 806*a* of the through hole 806 in the coupling retracting member 80 comes into contact with the second contact portion 723 of the first developing device coupling 72.

As illustrated in FIG. 7, a first downwardly pressing portion 808 having a substantially solid cylindrical shape is provided on the right end portion of the top end surface 801 of the coupling retracting member 80 so as to project sideways (upward). A first upwardly pressing portion 809 having a solid semicylindrical shape is provided on the top end surface 801 of the coupling retracting member 80 so as to project sideways (upward) at a position that is a certain distance to the left of the first downwardly pressing portion 808. The first upwardly pressing portion 809 is closer to the front surface than the first downwardly pressing portion 808 is on the top end surface 801.

A second downwardly pressing portion 810 having a substantially solid cylindrical shape is provided on a central portion of the bottom end surface 802 of the coupling retracting member 80 so as to project sideways (downward). The second downwardly pressing portion 810 is longer than the first downwardly pressing portion 808. A second upwardly pressing portion 811 having a solid semicylindrical shape is provided on the bottom end surface 802 of the coupling retracting member 80 so as to project downward at a position that is a certain distance to the left of the second downwardly pressing portion 810. The second upwardly pressing portion 811 is closer to the front surface than the second downwardly pressing portion 810 is on the bottom end surface 802.

As illustrated in FIGS. 7 and 8, the left side surface 803 of the coupling retracting member 80 has a step portion 812 that is recessed from the front surface of the coupling retracting member 80 and that extends along the left side surface 803.

Figure 20:
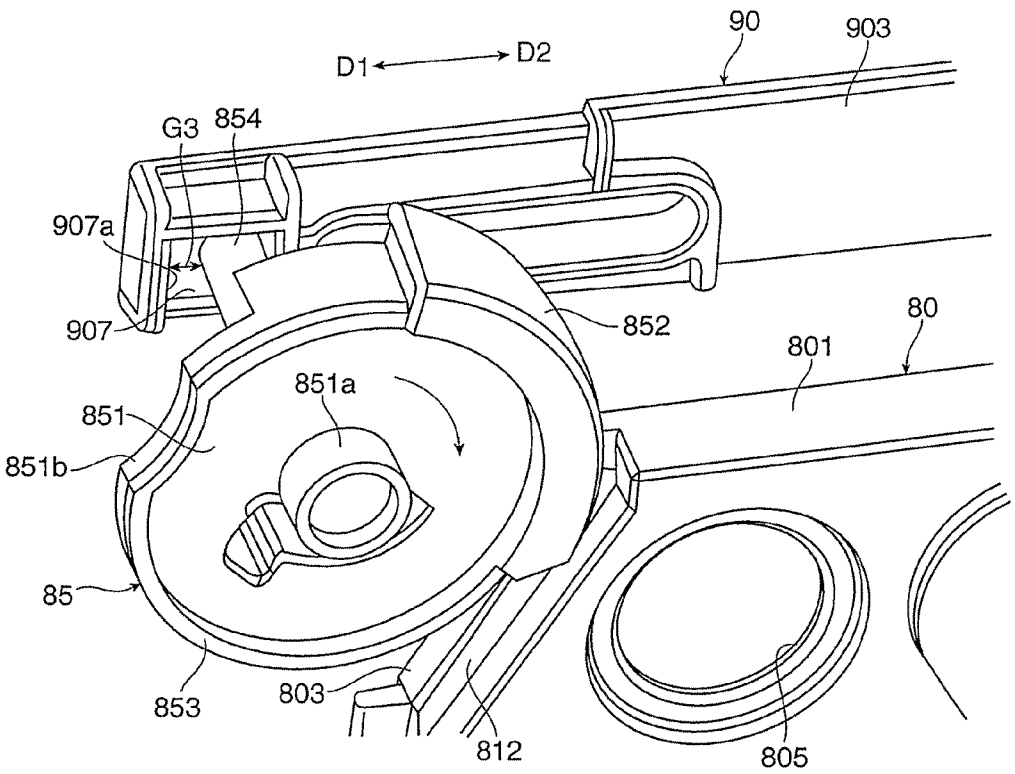
FIG. 20 is a perspective view of a portion of the drive transmission mechanism according to the exemplary embodiment of the present invention.

As illustrated in FIG. 7, the rotating cam 85 is rotatably disposed between the coupling retracting member 80 and the first fixing device coupling 73. The rotating cam 85 includes a disc-shaped cam body 851 that is rotatably supported by a shaft support portion 851*a*. The cam body 851 includes first and second cam portions 852 and 853 at the outer peripheral edge thereof. The first and second cam portions 852 and 853 are convexly curved toward one side in the axial direction (downward in FIG. 7). The first and second cam portions 852 and 853 are disposed on the outer peripheral edge of the cam body 851 so as to face each other with an angle of about 180 degrees therebetween. The first cam portion 852 comes into contact with the step portion 812 of the coupling retracting member 80 and presses the coupling retracting member 80 downward. The second cam portion 853 comes into contact with the third contact portion 733 of the first fixing device coupling 73 and presses the first fixing device coupling 73 downward. In consideration of the height difference between the step portion 812 of the coupling retracting member 80 and the third contact portion 733 of the first fixing device coupling 73 in the axial direction, the first and second cam portions 852 and 853 are arranged so that the first cam portion 852 projects upward beyond the second cam portion 853 in the axial direction of the cam body 851. As illustrated in FIG. 20, a driving shaft 854 that enables a link member 90, which will be described below, to rotationally drive the rotating cam 85 is provided on the cam body 851 at a position displaced from the shaft support portion 851*a* toward the link member 90. A concave cut portion 851*b* is formed in the outer periphery of the cam body 851 to prevent interference with the second fixing device coupling 79 during assembly.

The first and second cam portions 852 and 853 of the rotating cam 85 are configured so that the coupling retracting member 80 and the first fixing device coupling 73 are pressed downward at different times. More specifically, the amounts of projection of the first and second cam portions 852 and 853 and the positions at which the first and second cam portions 852 and 853 project in the circumferential direction of the cam body 851 are set so that when the rotating cam 85 rotates, the second cam portion 853 starts to press the first fixing device coupling 73 downward after the first cam portion 852 starts to press the coupling retracting member 80 downward.

Link Member (Moving Unit)

Figure 18:
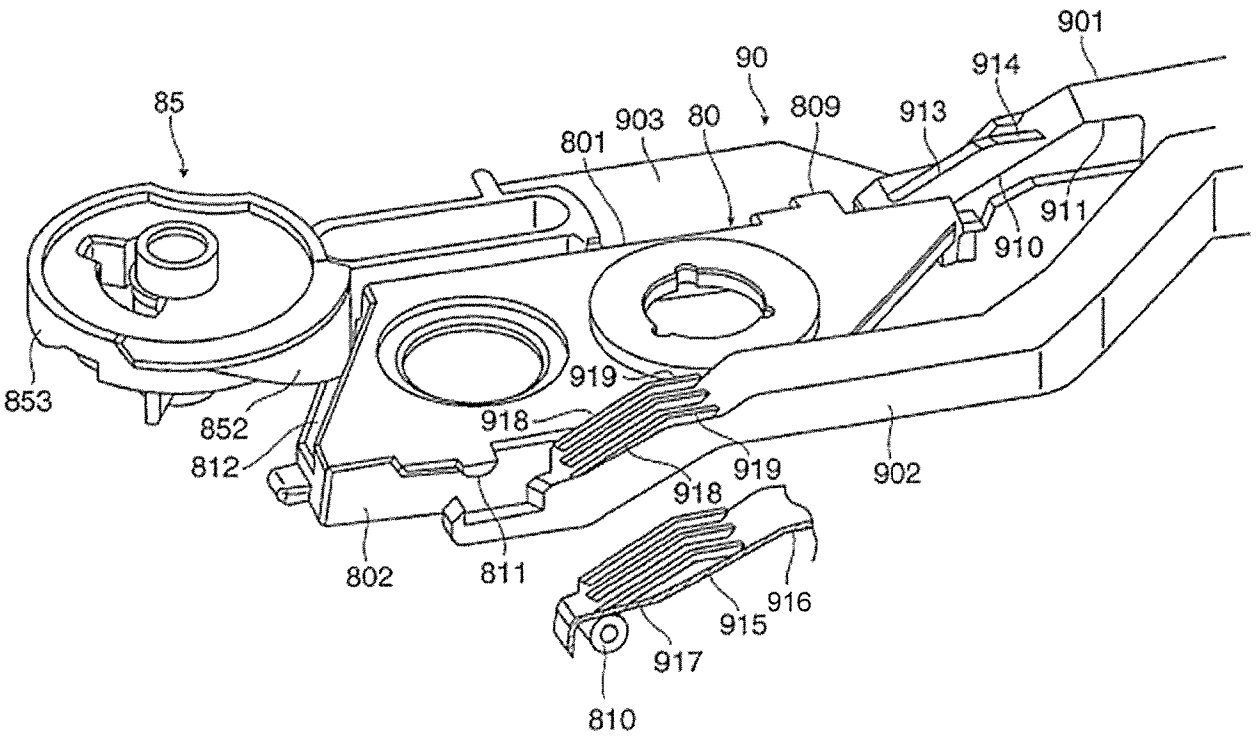
FIG. 18 is a perspective view of a portion of the drive transmission mechanism according to the exemplary embodiment of the present invention.

As illustrated in FIG. 6, the link member 90 is attached to the device board 51. The link member 90 is an example of a moving unit that moves the coupling retracting member 80 in an axial direction while maintaining the position of the coupling retracting member 80 in a direction crossing the axial direction. The link member 90 has a function of rotating the rotating cam 85. The link member 90 also has a function of moving the first toner supply coupling 76 in the axial direction. The link member 90 is attached to the device board 51 such that the link member 90 is movable along the surface of the device board 51 in the direction of arrows D1 and D2, which is a direction crossing the axial direction of the device board 51. As illustrated in FIG. 18, the link member 90 and the coupling retracting member 80 are disposed on substantially the same plane.

Figure 16:
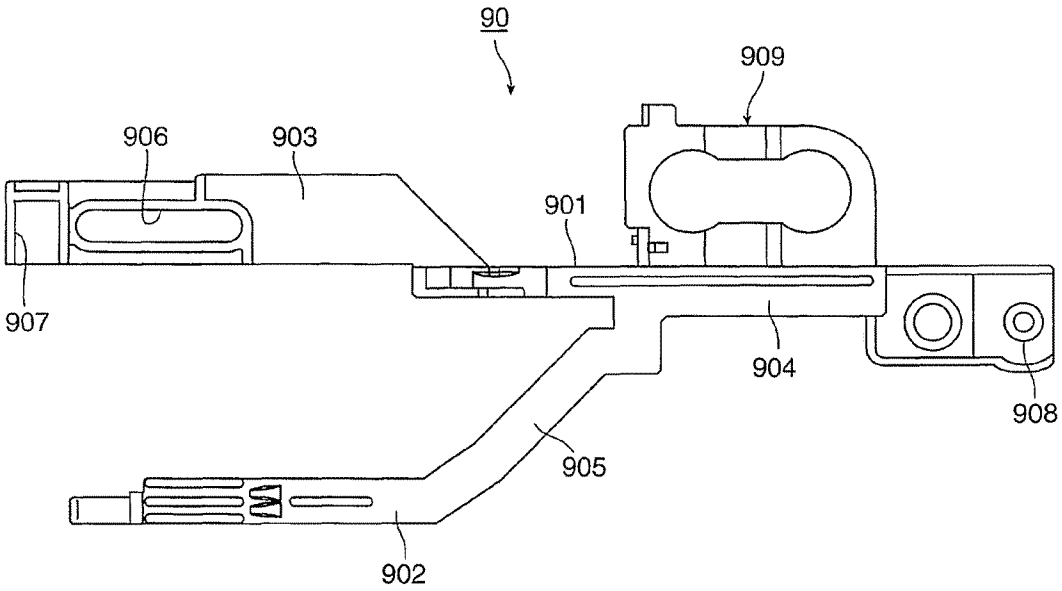
FIG. 16 is a front view of a link member.

As illustrated in FIG. 16, the link member 90 substantially has the shape of a sideways letter "Y" in front view. The link member 90 includes first and second link portions 901 and 902, a guide portion 903, and a base end portion 904. The first and second link portions 901 and 902 are disposed outside the top end surface 801 and the bottom end surface 802 of the coupling retracting member 80 and extend parallel to the top end surface 801 and the bottom end surface 802. The guide portion 903 is substantially flat-plate-shaped and extends parallel to the top end surface 801 of the coupling retracting member 80 on a side of (above) an end portion of the first link portion 901. The base end portion 904 extends straight from the right end portion of the first link portion 901 in the longitudinal direction. The second link portion 902 is integrally connected to the base end portion 904 by a joining portion 905 that extends substantially parallel to the right side surface 804 of the coupling retracting member 80.

The link member 90 has an elongated hole 906 in an end portion of the guide portion 903. The guide portion 903 has a recess 907, which is downwardly open in FIG. 16 for rotating the rotating cam 85, at an end thereof. A solid cylindrical shaft 908 is provided at the base end of the base end portion 904 of the link member 90. A toner supply retracting portion 909 that retracts the first toner supply coupling 76 by moving the first toner supply coupling 76 in the axial direction is provided on a side of (above) the base end portion 904 of the link member 90.

Referring to FIG. 6, a solid cylindrical shaft support portion 91 arranged to project from the device board 51 is inserted in the elongated hole 906 formed in the end portion of the guide portion 903, and the bottom side surface of the second link portion 902 is guided by a guide member 92 arranged to project from the device board 51. Thus, the link member 90 is attached to the device board 51 such that the link member 90 is movable in the direction of arrows D1 and D2.

Figure 17:
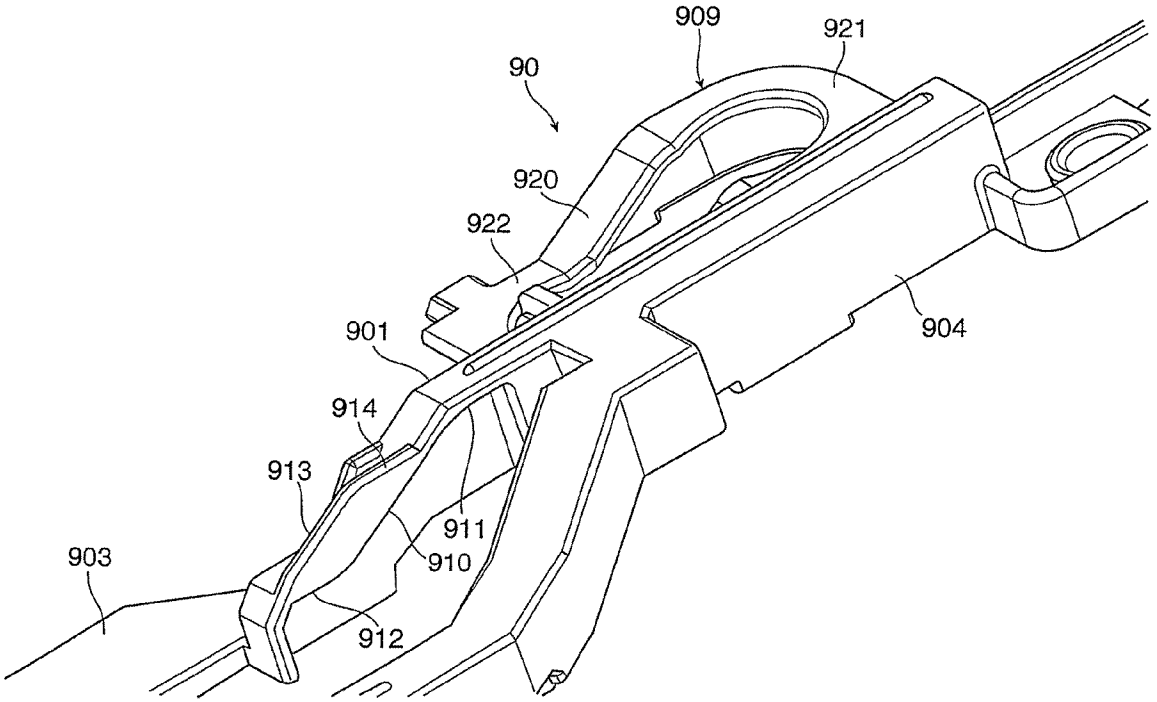
FIG. 17 is a perspective view of a portion of the link member.

As illustrated in FIG. 17, the link member 90 has a first inclined surface 910 defining an opening that faces the coupling retracting member 80 at an end of the first link portion 901. The first inclined surface 910 is inclined in a direction crossing the surface of the device board 51 so that the end thereof adjacent to the base end portion 904 of the link member 90 is higher than the end thereof adjacent to the guide portion 903 of the link member 90. Flat surfaces 911 and 912 are provided at both ends of the first inclined surface 910. A single first rib 913 that is inclined in a direction substantially parallel to the first inclined surface 910 is provided on the surface of the first link portion 901. The first rib 913 has a flat top end portion 914.

As illustrated in the partially cutaway view in FIG. 18, the link member 90 also has a second inclined surface 915 defining an opening that faces the coupling retracting member 80 at an end of the second link portion 902. The second inclined surface 915 basically has a structure similar to that of the first inclined surface 910 except for the position thereof in the longitudinal direction of the link member 90. The second inclined surface 915 is inclined in a direction crossing the surface of the device board 51 so that the end thereof adjacent to the base end portion 904 is higher than the other end thereof. Flat surfaces 916 and 917 are provided at both ends of the second inclined surface 915. Three second ribs 918 that are inclined in a direction substantially parallel to the second inclined surface 915 are provided on the surface of the second link portion 902. The second ribs 918 have flat top end portions 919.

Figure 19A:
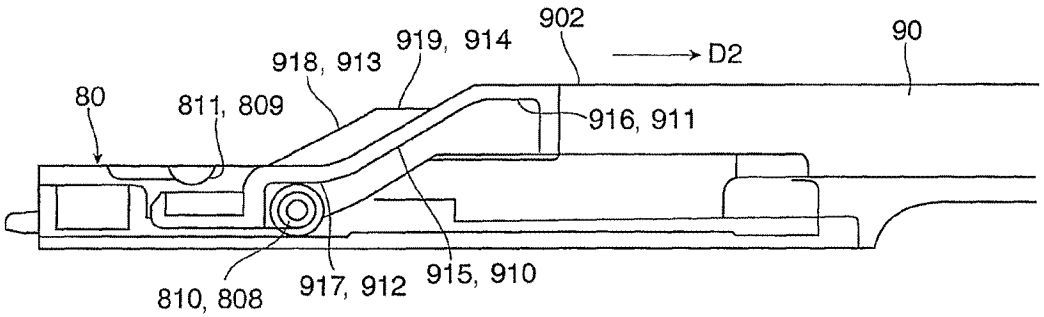
FIGS. 19A and 19B are sectional views illustrating the operation of the drive transmission mechanism according to the exemplary embodiment of the present invention.
Figure 19B:
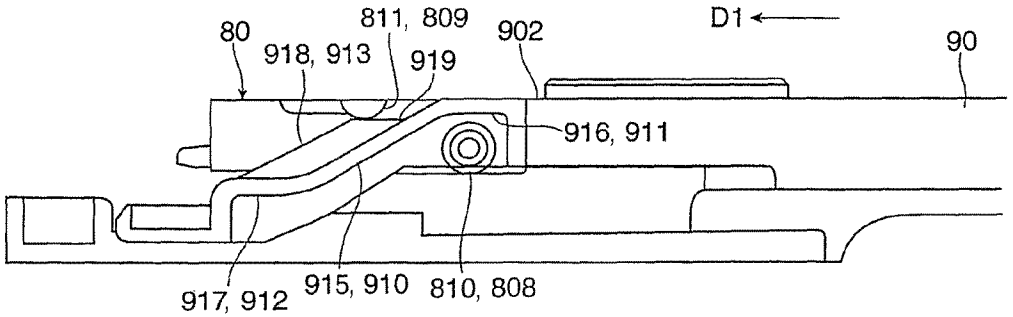

As illustrated in FIG. 19A, when the link member 90 is moved in the direction of arrow D2, the first and second inclined surfaces 910 and 915 of the first and second link portions 901 and 902 respectively come into contact with the first and second downwardly pressing portions 808 and 810 of the coupling retracting member 80, and press the first and second downwardly pressing portions 808 and 810 so that the coupling retracting member 80 is moved toward the back side of the device board 51 (downward in FIGS. 19A and 19B) in the axial direction. In FIGS. 19A and 19B, only the second inclined surface 915 is illustrated for convenience, and the reference numerals of the first inclined surface 910 and other related parts are shown together with the reference numerals of parts corresponding thereto after a comma. In the illustrated state, the first and second downwardly pressing portions 808 and 810 of the coupling retracting member 80 are respectively pressed against the flat surfaces 912 and 917 of the link member 90 by the urging force of the first and second coil springs 714 and 725, and are stationary.

As illustrated in FIG. 19B, when the link member 90 is moved in the direction of arrow D1, the first and second ribs 913 and 918 of the first and second link portions 901 and 902 respectively come into contact with the first and second upwardly pressing portions 809 and 811 of the coupling retracting member 80, and press the first and second upwardly pressing portions 809 and 811 so that the coupling retracting member 80 is moved forward in the axial direction. In the illustrated state, the first and second upwardly pressing portions 809 and 811 of the coupling retracting member 80 are respectively in contact with the flat top end portions 914 and 919 of the first and second ribs 913 and 918, and are stationary. The first and second downwardly pressing portions 808 and 810 of the coupling retracting member 80 are respectively separated from the flat surfaces 911 and 916 of the link member 90.

As illustrated in FIG. 20, an end portion of the driving shaft 854 of the rotating cam 85 is engaged with the recess 907 at the end of the guide portion 903 of the link member 90. FIG. 20 illustrates the state in which the link member 90 has been fully moved in the direction of arrow D1. In this state, a gap G3 is provided between an inner surface 907*a* of the recess 907 in the guide portion 903 and the outer peripheral surface of the driving shaft 854. When the link member 90 in this state starts to move in the direction of arrow D2, the inner surface 907*a* of the recess 907 comes into contact with the driving shaft 854 of the rotating cam 85 and starts to push the driving shaft 854 and rotate the rotating cam 85 clockwise in FIG. 20 after moving by a distance corresponding to the gap G3. Thus, the rotating cam 85 starts to rotate later than the start of movement of the link member 90 by a time corresponding to the gap G3. Then, the first cam portion 852 starts to press the step portion 812 of the coupling retracting member 80 downward. As described above, the rotating cam 85 is structured so that the second cam portion 853 starts to press the third contact portion 733 of the first fixing device coupling 73 downward after the first cam portion 852 starts to press the coupling retracting member 80 downward.

Figure 21:
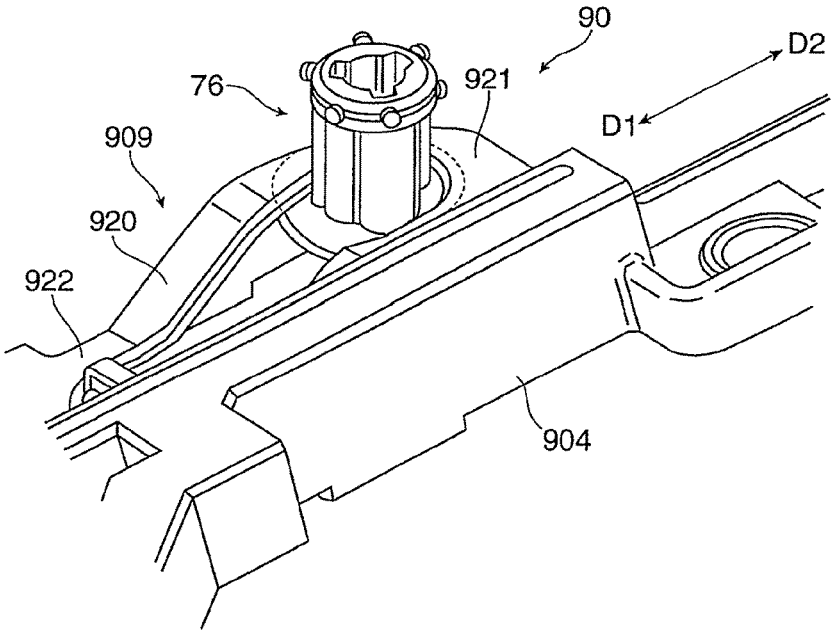
FIG. 21 is a perspective view of a portion of the drive transmission mechanism according to the exemplary embodiment of the present invention.

As illustrated in FIGS. 16 and 21, the link member 90 includes the toner supply retracting portion 909. The toner supply retracting portion 909 includes a third inclined surface 920 having a passage along which the first toner supply coupling 76 extending therethrough is moved, and flat surfaces 921 and 922 that are provided at both ends of the third inclined surface 920 and that have circular openings connected to the passage. The third inclined surface 920 is inclined in a direction crossing the surface of the device board 51 such that the flat surface 921 near the base end portion 904 of the link member 90 is higher than the flat surface 922 near the guide portion 903 of the link member 90.

Referring to FIG. 21, when the link member 90 is moved in the direction of arrow D2, the fourth contact portion 763 of the first toner supply coupling 76 moves along the third inclined surface 920 to the flat surface 922 provided at one end of the third inclined surface 920. Accordingly, the first toner supply coupling 76 moves toward the surface of the device board 51 against the urging force of the fourth coil spring 765, and is disengaged from the second toner supply coupling 77.

When the link member 90 is moved in the direction of arrow D1, the fourth contact portion 763 of the first toner supply coupling 76 moves along the third inclined surface 920 to the flat surface 921 provided at the other end of the third inclined surface 920. Accordingly, the first toner supply coupling 76 is moved away from the surface of the device board 51 by the urging force of the fourth coil spring 765, and is engaged with the second toner supply coupling 77.

Link Member Moving Mechanism

As illustrated in FIG. 6, the link member 90 is connected to a rotating body 67 by an operating arm 66 that is connected to the shaft 908 on the base end portion 904. The rotating body 67 rotates in the directions of arrows E1 and E2 by a certain rotation angle in response to the opening-closing operation of the front cover 101.

Figure 22A:
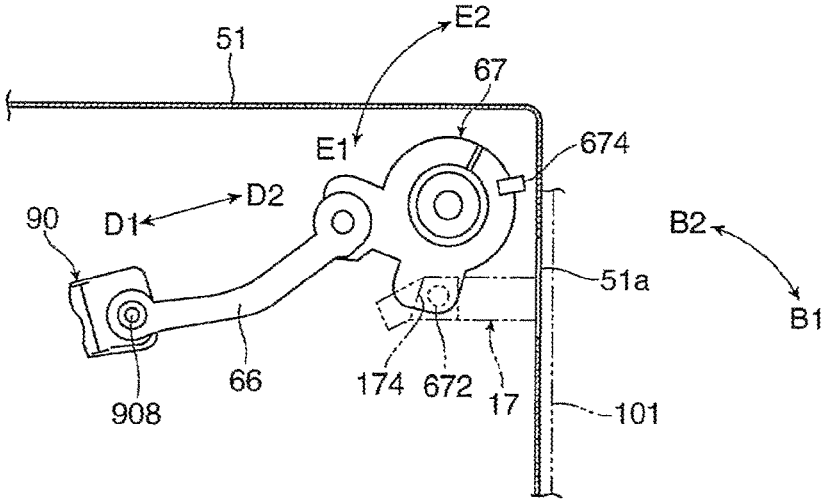
FIGS. 22A and 22B illustrate a front-cover opening-closing mechanism.
Figure 23:
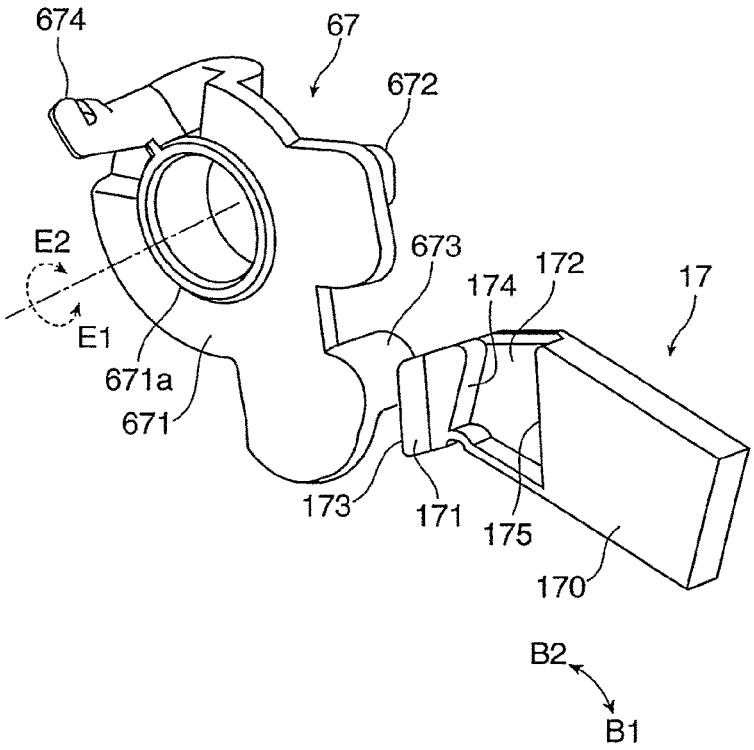
FIG. 23 is a perspective view illustrating a rotating body and a contact operation portion of a front cover.

As illustrated in FIG. 22A, the rotating body 67 is provided on a top front portion (top right portion in FIG. 22A) of the device board 51. The rotating body 67 is rotated when the contact operation portion 17 provided on the front cover 101 comes into contact therewith. As illustrated in FIG. 23, the rotating body 67 includes a body 671 having a hollow cylindrical shaft support portion 671*a* at the center thereof; an operating projection 672 that projects sideways from the shaft support portion 671*a*; a contact portion 673 with which the contact operation portion 17 comes into contact; and an engagement portion 674 that is disposed at a position opposite the contact portion 673 and to which an urging unit, such as a coil spring (not shown), is engaged. The coil spring (not shown) is engaged with the engagement portion 674 so as to urge the rotating body 67 in the direction of arrow E1 when the rotating body 67 is rotated in the direction of arrow E1 beyond a specific neutral rotation position in the circumferential direction, and in the direction of arrow E2 when the rotating body 67 is rotated in the direction of arrow E2 beyond the specific neutral rotation position in the circumferential direction. The operating arm 66 is rotatably supported at one end thereof at a position adjacent to the contact portion 673.

As illustrated in FIG. 23, the contact operation portion 17 includes a plate-shaped body portion 170 that projects perpendicularly from the inner surface of the front cover 101 at a predetermined position near one end of the front cover 101, a bent end portion 171 that extends obliquely downward at an end of the body portion 170, and a portion having a recess 172 that extends downward at the boundary between the body portion 170 and the bent end portion 171. The contact operation portion 17 also has a contact surface 173 at an end of the bent end portion 171. The contact surface 173 comes into contact with and pushes the contact portion 673 of the rotating body 67 when the front cover 101 is closed.

The contact operation portion 17 is structured such that an inner wall surface of the recess 172 that is near the contact surface 173 serves as a pulling inclined surface 174, which is inclined downward and outward and comes into contact with the operating projection 672 of the rotating body 67 when the front cover 101 is opened. An inner wall surface of the recess 172 that is far from the contact surface 173 serves as a pushing inclined surface 175, which is inclined downward and outward and comes into contact with the operating projection 672 of the rotating body 67 when the front cover 101 is closed.

Referring to FIG. 22A, the front cover 101 is opened by rotating the front cover 101 in the direction of arrow B1. When the front cover 101 starts to rotate, the pulling inclined surface 174 on the contact operation portion 17 of the front cover 101 comes into contact with the operating projection 672 on the rotating body 67, and the rotating body 67 starts to rotate in the direction of arrow E1. As described above, the rotating body 67 is urged by the coil spring (not shown), and is stopped after being rotated to a predetermined position in the direction of arrow E1. Accordingly, the driving force generated when the rotating body 67 is rotated in the direction of arrow E1 is transmitted to the link member 90 through the operating arm 66. The link member 90 is moved by the operating arm 66 by a certain distance in the direction of arrow D2.

Figure 22B:
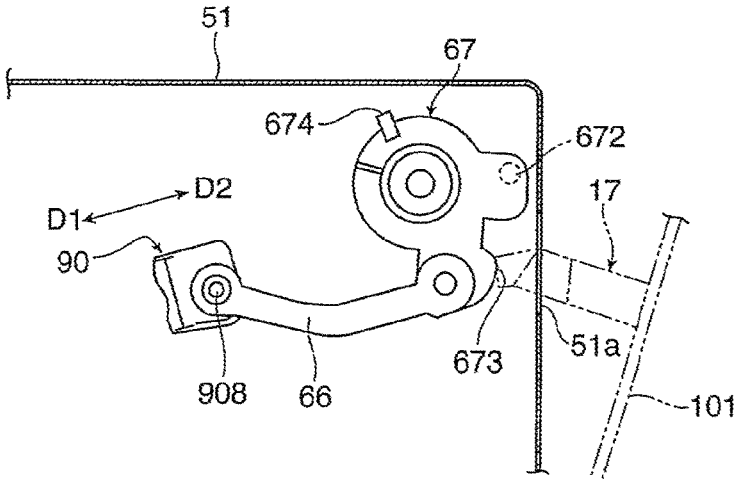

When the front cover 101 is closed by rotating the front cover 101 in the direction of arrow B2, as illustrated in FIG. 22B, the contact surface 173 of the contact operation portion 17 of the front cover 101 comes into contact with the contact portion 673 of the rotating body 67, and the rotating body 67 starts to rotate in the direction of arrow E2. As described above, the rotating body 67 is urged by the coil spring (not shown) and is stopped after being rotated to a predetermined position in the direction of arrow E2. Accordingly, the driving force generated when the rotating body 67 is rotated in the direction of arrow E2 is transmitted to the link member 90 through the operating arm 66. The link member 90 is moved by the operating arm 66 by a certain distance in the direction of arrow D1. In FIGS. 22A and 22B, reference numeral 51*a* denotes an opening that is formed in a flange portion provided at the front side of the device board 51 and through which the contact operation portion 17 is inserted.

Operation of Drive Transmission Mechanism and Driving Device

The drive transmission mechanism 70 of the driving device 50 included in the image forming apparatus 1 according to the exemplary embodiment switches between a state in which transmission of the rotational driving force to the process cartridge 300, the toner cartridge 145, and other components is enabled and a state in which the transmission of the rotational driving force is disabled in response to the opening-closing operation of the front cover 101 of the apparatus body 1*a*, as will now be described.

Referring to FIG. 5, when, for example, the toner cartridge 145 and the process cartridge 300 are to be newly attached to the image forming apparatus 1 according to the present exemplary embodiment or when the toner cartridge 145 and the process cartridge 300 are to be replaced, the front cover 101 is opened in the direction of arrow B1 to expose the opening 105. As illustrated in FIG. 22B, when the front cover 101 of the image forming apparatus 1 is opened in the direction of arrow B1, the contact operation portion 17 provided on the front cover 101 is moved away from the rotating body 67 so as to be retracted from the rotating body 67. When the contact operation portion 17 is retracted from the rotating body 67, the rotating body 67 is rotated by a certain angle in the direction of arrow E1 by the urging force applied by the coil spring (not shown), and then stops. The rotation of the rotating body 67 is transmitted to the link member 90 through the operating arm 66, so that the link member 90 is moved by a certain distance in the direction of arrow D2, and then stops.

Figure 24:
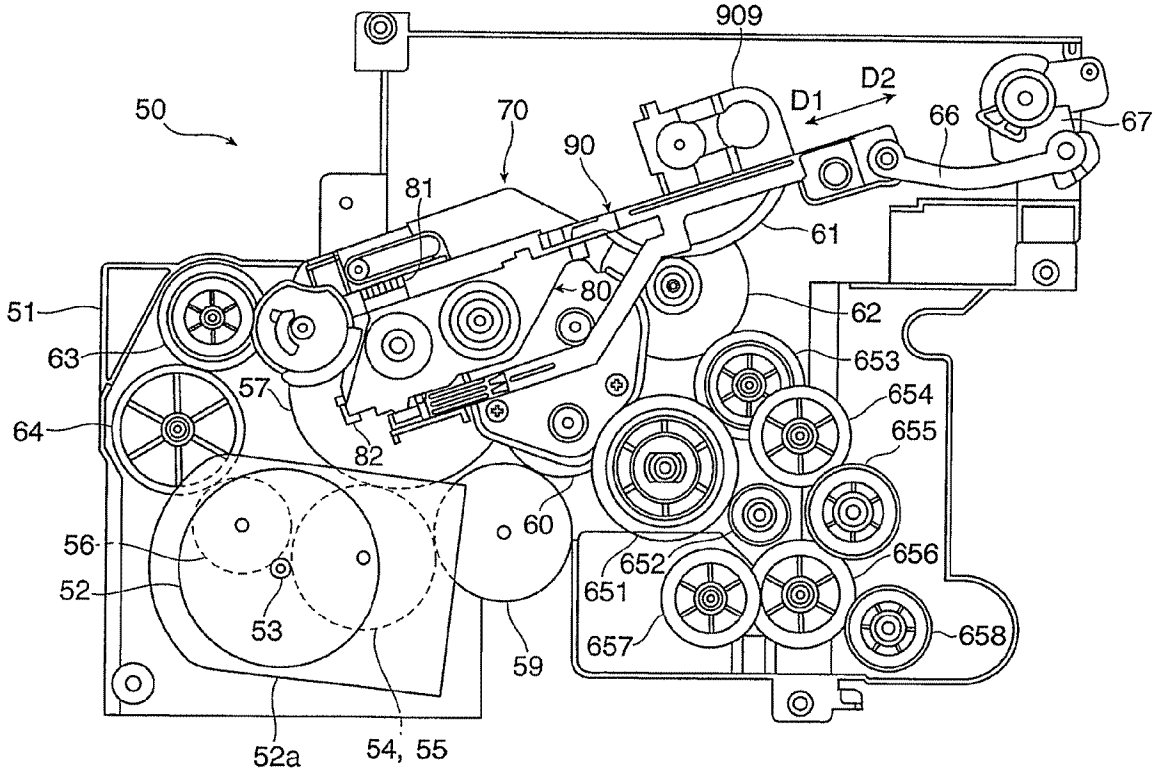
FIG. 24 illustrates the driving device incorporating the drive transmission mechanism according to the exemplary embodiment of the present invention in a disengaged state.

FIG. 24 illustrates the driving device 50 after the front cover 101 has been opened and the link member 90 has been moved by a certain distance in the direction of arrow D2 and then stopped.

Referring to FIG. 24, when the link member 90 is moved by a certain distance in the direction of arrow D2, the coupling retracting member 80 moves toward the surface of the device board 51 (toward the back side in FIG. 24) in response to the movement of the link member 90.

As illustrated in FIG. 19A, the moving force of the link member 90 that moves in the direction of arrow D2 is transmitted to the coupling retracting member 80 through the first and second downwardly pressing portions 808 and 810 that respectively come into contact with the first and second inclined surfaces 910 and 915 of the link member 90. When the first and second downwardly pressing portions 808 and 810 respectively come into contact with the first and second inclined surfaces 910 and 915 of the link member 90 and are pressed downward, the coupling retracting member 80 moves downward in FIGS. 19A and 19B toward the surface of the device board 51, and stops at a retracted position.

Figure 25:
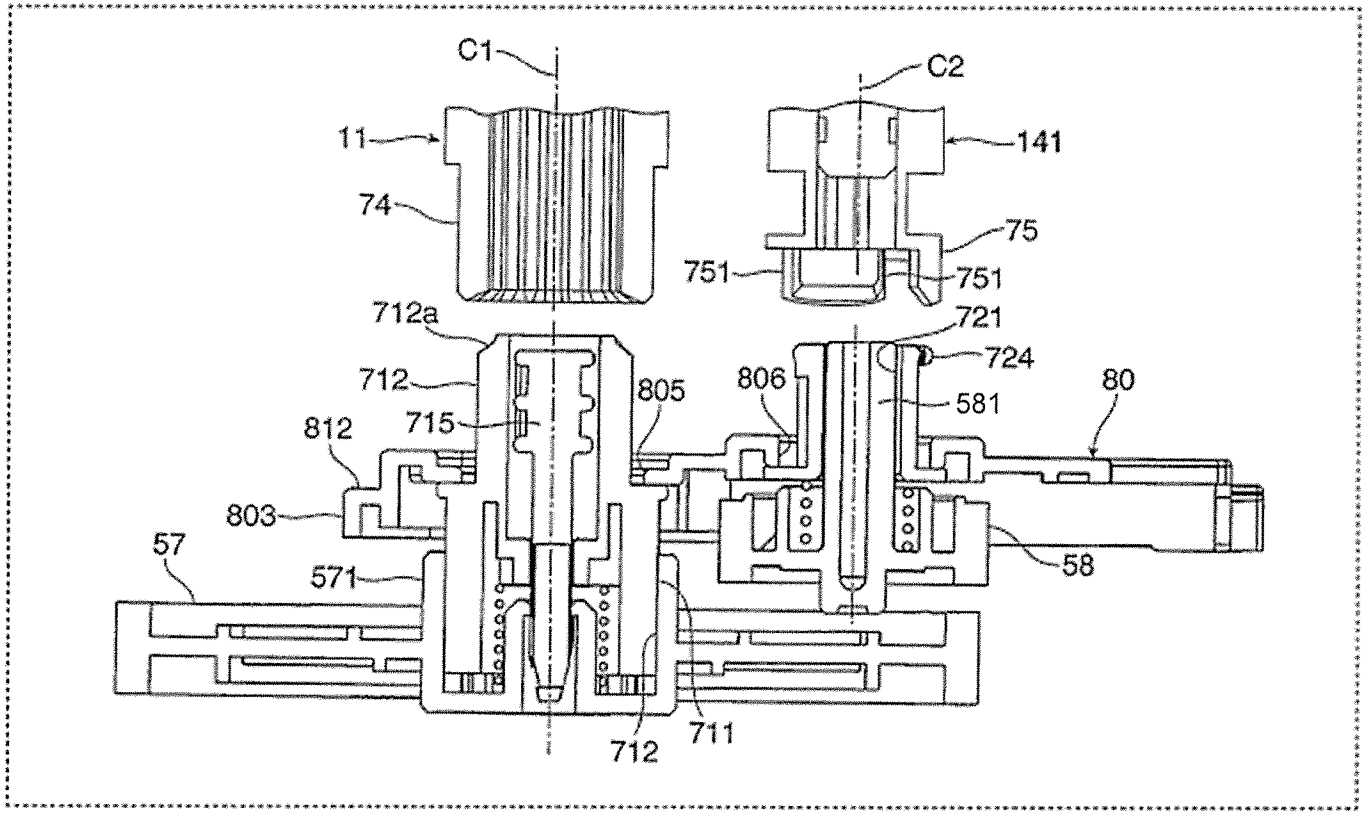
FIG. 25 is a sectional view of the driving device incorporating the drive transmission mechanism according to the exemplary embodiment of the present invention in the disengaged state.

As illustrated in FIG. 25, when the coupling retracting member 80 moves to the retracted position, the first photoconductor coupling 71 and the first developing device coupling 72, which are inserted through the two through holes 805 and 806, are pressed downward against the urging force of the first and second coil springs 714 and 725, respectively. Accordingly, the first photoconductor coupling 71 and the first developing device coupling 72 are respectively moved away from the second photoconductor coupling 74 and the second developing device coupling 75. As a result, as illustrated in FIG. 11, the drive transmission mechanism 70 is set to a state in which the transmission of the rotational driving force from the first photoconductor coupling 71 and the first developing device coupling 72 on the apparatus body 1*a* to the second photoconductor coupling 74 and the second developing device coupling 75 on the process cartridge 300 is disabled.

At this time, as illustrated in FIG. 18, the rotating cam 85 is rotationally driven by the movement of the link member 90 in the direction of arrow D2, so that the first cam portion 852 of the rotating cam 85 presses the step portion 812 of the coupling retracting member 80 downward to assist the link member 90 in moving the coupling retracting member 80. The time at which the rotating cam 85 assists in moving the coupling retracting member 80 is set to be later than the time at which the link member 90 starts to move the coupling retracting member 80 toward the retracted position.

Figure 26:
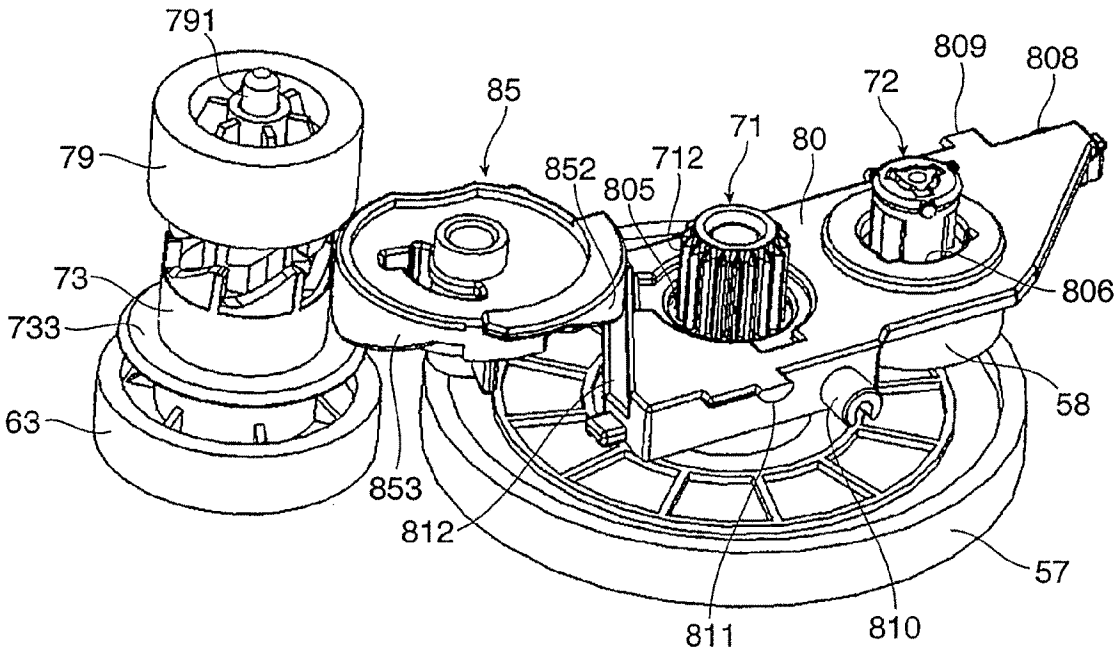
FIG. 26 is a perspective view of the driving device incorporating the drive transmission mechanism according to the exemplary embodiment of the present invention in the disengaged state.

As illustrated in FIG. 26, the second cam portion 853 of the rotating cam 85 comes into contact with the third contact portion 733 of the first fixing device coupling 73 and presses the first fixing device coupling 73 downward against the urging force of the third coil spring 735, so that the first fixing device coupling 73 is moved away from the second fixing device coupling 79 and that the first fixing device coupling 73 and the second fixing device coupling 79 are disengaged from each other. Thus, the drive transmission mechanism 70 is set to a state in which the transmission of the rotational driving force from the first fixing device coupling 73 to the second fixing device coupling 79 is disabled.

As illustrated in FIG. 21, the moving force of the link member 90 that moves in the direction of arrow D2 causes the third inclined surface 920 of the toner supply retracting portion 909 to press the first toner supply coupling 76 downward, so that the first toner supply coupling 76 is moved away from the second toner supply coupling 77 against the urging force of the fourth coil spring 765. Thus, as illustrated in FIG. 15, the drive transmission mechanism 70 is set to a state in which the transmission of the rotational driving force from the first toner supply coupling 76 to the second toner supply coupling 77 is disabled.

As described above, the drive transmission mechanism 70 included in the image forming apparatus 1 is set to a state in which the transmission of the rotational driving force to the process cartridge 300, the toner cartridge 145, and other devices including the fixing device 40 is disabled in response to the opening operation of the front cover 101. Thus, as illustrated in FIG. 5, the process cartridge 300 and the toner cartridge 145 are attachable to and removable from the apparatus body 1*a* of the image forming apparatus 1, so that the process cartridge 300 and the toner cartridge 145 may be, for example, installed or replaced.

After the toner cartridge 145 and the process cartridge 300 are replaced, for example, the front cover 101 of the image forming apparatus 1 is closed.

When the front cover 101 is closed, as illustrated in FIG. 22B, the contact surface 173 of the contact operation portion 17 of the front cover 101 comes into contact with the contact portion 673 of the rotating body 67, and the rotating body 67 starts to rotate in the direction of arrow E2. Accordingly, the driving force generated when the rotating body 67 is rotated in the direction of arrow E2 is transmitted to the link member 90 through the operating arm 66. The link member 90 is moved by a certain distance in the direction of arrow D1, and then stops.

Referring to FIG. 6, when the link member 90 is moved by a certain distance in the direction of arrow D1, the coupling retracting member 80 moves away from the surface of the device board 51 in response to the movement of the link member 90.

As illustrated in FIG. 19B, the moving force of the link member 90 that moves in the direction of arrow D1 is transmitted to the coupling retracting member 80 through the first and second upwardly pressing portions 809 and 811 of the coupling retracting member 80 that respectively come into contact with the first and second ribs 913 and 918 of the link member 90. When the link member 90 is moved in the direction of arrow D1, the first and second upwardly pressing portions 809 and 811 respectively come into contact with the first and second ribs 913 and 918 of the link member 90 and are pressed upward, so that the coupling retracting member 80 moves upward in FIG. 19B, away from the surface of the device board 51. The coupling retracting member 80 stops at the driving position at which the first and second upwardly pressing portions 809 and 811 are respectively in contact with the flat surfaces 914 and 919 of the link member 90.

As illustrated in FIG. 8, when the coupling retracting member 80 is moved to the driving position in the direction away from the surface of the device board 51, the first photoconductor coupling 71 and the first developing device coupling 72 are moved to their respective driving positions at which the first photoconductor coupling 71 and the first developing device coupling 72 are respectively engaged with the second photoconductor coupling 74 and the second developing device coupling 75 by the urging forces of the first and second coil springs 714 and 725. As a result, as illustrated in FIG. 12, the drive transmission mechanism 70 is set to a state in which the first photoconductor coupling 71 and the first developing device coupling 72 on the apparatus body 1*a* are respectively engaged with the second photoconductor coupling 74 and the second developing device coupling 75 on the process cartridge 300 and the transmission of the rotational driving force is enabled.

Figure 27:
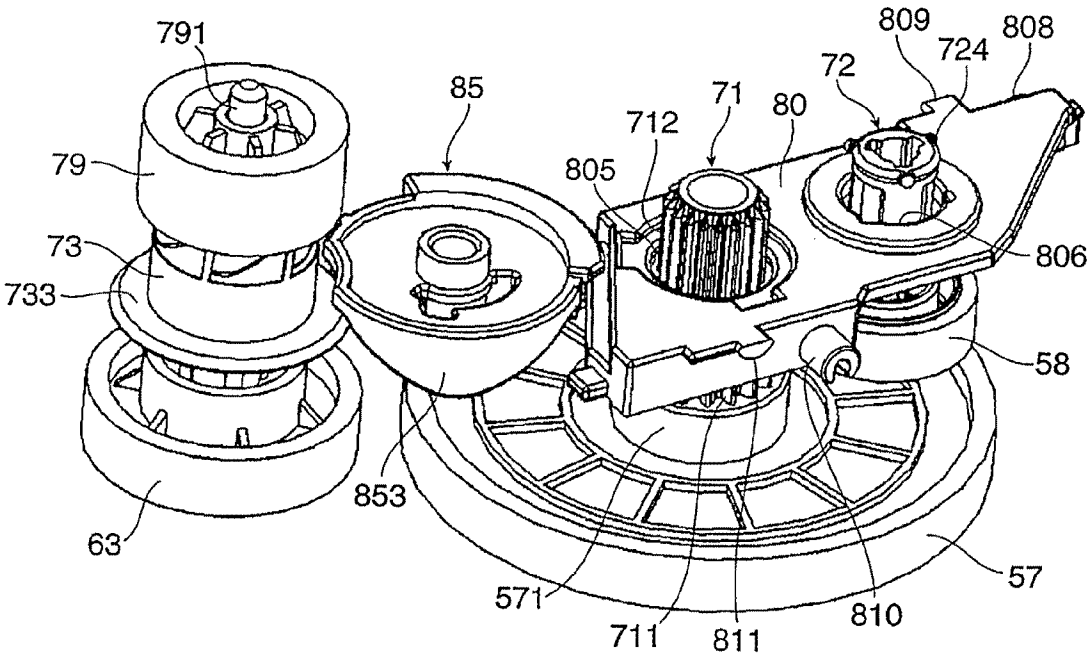
FIG. 27 is a perspective view of the driving device incorporating the drive transmission mechanism according to the exemplary embodiment of the present invention in an engaged state.

At this time, as illustrated in FIG. 27, the rotating cam 85 is rotationally driven by the movement of the link member 90 in the direction of arrow D1 so that the first cam portion 852 moves away from the step portion 812 to enable the coupling retracting member 80 to move upward. The time at which the rotating cam 85 enables the movement of the coupling retracting member 80 is set to be later than the time at which the first and second upwardly pressing portions 809 and 811 of the coupling retracting member 80 start to move along the first and second ribs 913 and 918 of the link member 90.

As illustrated in FIG. 27, the second cam portion 853 of the rotating cam 85 moves away from the third contact portion 733 of the first fixing device coupling 73 and releases the first fixing device coupling 73 that has been pressed downward, so that the first fixing device coupling 73 engages with the second fixing device coupling 79 due to the urging force of the third coil spring 795. Thus, the drive transmission mechanism 70 is set to a state in which the transmission of the rotational driving force from the first fixing device coupling 73 to the second fixing device coupling 79 is enabled.

As illustrated in FIG. 21, the moving force of the link member 90 that moves in the direction of arrow D1 causes the third inclined surface 920 of the toner supply retracting portion 909 to release the first toner supply coupling 76 that has been pressed downward, so that the first toner supply coupling 76 engages with the second toner supply coupling 77 due to the urging force of the fourth coil spring 765. Thus, the drive transmission mechanism 70 enables the transmission of the rotational driving force from the first toner supply coupling 76 to the second toner supply coupling 77.

As described above, the driving device 50 incorporating the drive transmission mechanism 70 according to the above-described exemplary embodiment is configured such that the coupling retracting member 80, which moves the first photoconductor coupling 71 and the first developing device coupling 72 in the axial direction of the rotation axes C1 and C2, performs both the operation of engaging the first photoconductor coupling 71 and the first developing device coupling 72 on the apparatus body 1*a* with the second photoconductor coupling 74 and the second developing device coupling 75 on the process cartridge 300 to enable the transmission of the rotational driving force and the operation of disengaging the first photoconductor coupling 71 and the first developing device coupling 72 on the apparatus body 1*a* from the second photoconductor coupling 74 and the second developing device coupling 75 on the process cartridge 300 to disable the transmission of the rotational driving force.

Accordingly, when the coupling retracting member 80 is moved, the first photoconductor coupling 71 and the first developing device coupling 72 on the apparatus body 1*a* respectively become engaged with and disengaged from the second photoconductor coupling 74 and the second developing device coupling 75 on the process cartridge 300 by being moved in the axial direction of the rotation axes C1 and C2, and are prevented from moving while being inclined with respect to the rotation axes C1 and C2. As a result, when the first photoconductor coupling 71 and the first developing device coupling 72 respectively become engaged with and disengaged from the second photoconductor coupling 74 and the second developing device coupling 75, the first photoconductor coupling 71 and the first developing device coupling 72 are prevented from gouging the second photoconductor coupling 74 and the second developing device coupling 75, that is, coming into contact with the second photoconductor coupling 74 and the second developing device coupling 75 while being inclined with respect to the rotation axes C1 and C2.

According to the driving device 50 incorporating the drive transmission mechanism 70 of the exemplary embodiment, the risk that the first photoconductor coupling 71 and that the first developing device coupling 72 will gouge the second photoconductor coupling 74 and the second developing device coupling 75, respectively, is reduced or eliminated. Therefore, the risk that the first photoconductor coupling 71, the first developing device coupling 72, the second photoconductor coupling 74, and that the second developing device coupling 75 will partially wear and the transmission accuracy of the rotational driving force will be reduced is reduced or eliminated. Accordingly, the photoconductor drum 11 and the developing roller 14 of the developing device 141 attached to the process cartridge 300 may be accurately rotationally driven for a long period of time.

COMPARATIVE EXAMPLES

In contrast, according to Japanese Unexamined Patent Application Publication No. 2015-102770, a driving-side drive transmission member is moved by an inclined surface of a switching member so as to become engaged with and disengaged from a receiving-side drive transmission member that receives the rotational driving force.

Therefore, according to Japanese Unexamined Patent Application Publication No. 2015-102770, when the driving-side drive transmission member is moved to become engaged with and disengaged from the receiving-side drive transmission member, there is a risk that the driving-side drive transmission member will be inclined with respect to the axial direction due to the inclined surface of the switching member and that gouging will occur between the driving-side drive transmission member and the receiving-side drive transmission member.

The technology according to Japanese Unexamined Patent Application Publication No. 2016-102893 is not applicable to drive transmission members having two rotation axes that are adjacent to each other.

The image forming apparatus according to the above-described exemplary embodiment is an image forming apparatus that forms a monochrome image. However, the present invention may, of course, also be applied to a full-color image forming apparatus that forms toner images of four colors, which are yellow (Y), magenta (M), cyan (C), and black (K).

In the exemplary embodiment, a photoconductor coupling and a developing device coupling are described as first drive transmission units arranged to be movable in the axial direction of rotation axes that are adjacent to each other. However, the present invention is not limited to this, and may, of course, instead be applied to, for example, plural photoconductor drums having plural rotation axes that are adjacent to each other.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A drive transmission mechanism comprising:

a plurality of first drive transmission units arranged to be movable in an axial direction of respective rotation axes that are adjacent to each other, each first drive transmission unit being rotationally driven;

a plurality of second drive transmission units, each of which is disposed adjacent to a corresponding one of the first drive transmission units in the axial direction and is capable of engaging with and disengaging from the corresponding one of the first drive transmission units to enable and disable transmission of a rotational driving force; and a switching unit disposed to maintain a position thereof in a direction crossing the axial direction, the switching unit moving each of the first drive transmission units in the axial direction to switch between a state in which the transmission of the rotational driving force is enabled and a state in which the transmission of the rotational driving force is disabled.

2. The drive transmission mechanism according to claim 1, further comprising:

a moving unit that moves in the direction crossing the axial direction, wherein the switching unit converts a movement of the moving unit into a movement in the axial direction to move each of the first drive transmission units in the axial direction.

3. The drive transmission mechanism according to claim 2, wherein the switching unit includes a rotating cam including a pushing portion that rotates in response to the movement of the moving unit and pushes at least one of the first drive transmission units in the axial direction.

4. The drive transmission mechanism according to claim 3, wherein the switching unit includes a pushing member that comes into contact with an inclined surface of the moving unit and pushes each of the first drive transmission units in the axial direction, and wherein the rotating cam pushes the pushing member in the axial direction.

5. The drive transmission mechanism according to claim 2, wherein the switching unit includes a pushing member that comes into contact with an inclined surface of the moving unit and pushes each of the first drive transmission units in the axial direction.

6. The drive transmission mechanism according to claim 5, wherein the pushing member pushes the first drive transmission units at different times.

7. The drive transmission mechanism according to claim 1, wherein each first drive transmission unit is urged by an urging unit in a direction such that the first drive transmission unit engages with a corresponding one of the second drive transmission units.

8. A driving device comprising:

a drive source;

a driven unit that is driven by a rotational driving force transmitted from the drive source; and a drive transmission unit that performs transmission of the rotational driving force from the drive source to the driven unit and that is capable of enabling and disabling the transmission of the rotational driving force, wherein the drive transmission mechanism according to claim 1 is used as the drive transmission unit.

9. An image forming apparatus comprising:

an image forming portion; and a driving unit that drives the image forming portion, wherein the driving device according to claim 8 is used as the driving unit.

10. An image forming apparatus comprising:

an apparatus body;

an image forming portion that is removably attached to the apparatus body;

an opening-closing unit that opens and closes to cover and expose an opening in the apparatus body; and a driving unit that drives the image forming portion, wherein the driving unit switches between a state in which transmission of a rotational driving force to the image forming portion is enabled and a state in which the transmission of the rotational driving force to the image forming portion is disabled in response to an opening-closing operation of the opening-closing unit, and wherein the driving device according to claim 8 is used as the driving unit.

* * * * *